US008837662B2

(12) United States Patent
Piefer

(10) Patent No.: US 8,837,662 B2
(45) Date of Patent: Sep. 16, 2014

(54) HIGH ENERGY PROTON OR NEUTRON SOURCE

(75) Inventor: Gregory Piefer, Middleton, WI (US)

(73) Assignee: Phoenix Nuclear Labs LLC, Middleton, WI (US)

( * ) Notice: Subject to any disclaimer, the term of this patent is extended or adjusted under 35 U.S.C. 154(b) by 471 days.

(21) Appl. No.: 12/810,958

(22) PCT Filed: Dec. 29, 2008

(86) PCT No.: PCT/US2008/088485

§ 371 (c)(1), (2), (4) Date: Jul. 26, 2010

(87) PCT Pub. No.: WO2009/142669

PCT Pub. Date: Nov. 26, 2009

(65) Prior Publication Data

US 2010/0284502 A1 Nov. 11, 2010

Related U.S. Application Data

(60) Provisional application No. 61/017,288, filed on Dec. 28, 2007, provisional application No. 61/139,985, filed on Dec. 22, 2008.

(51) Int. Cl.
*G21G 1/10* (2006.01)
*H05H 6/00* (2006.01)

(52) U.S. Cl.
CPC ... *G21G 1/10* (2013.01); *H05H 6/00* (2013.01)
USPC ..... 376/190

(58) Field of Classification Search
USPC ..... 376/190
See application file for complete search history.

(56) References Cited

U.S. PATENT DOCUMENTS

| | | | | | |
|---|---|---|---|---|---|
| 3,473,056 | A | * | 10/1969 | Ferry | 310/309 |
| 3,571,734 | A | * | 3/1971 | Consoli et al. | 315/500 |
| 3,676,672 | A | * | 7/1972 | Meckel et al. | 250/427 |
| 4,008,411 | A | * | 2/1977 | Brugger et al. | 376/117 |
| 4,497,768 | A | * | 2/1985 | Caldwell et al. | 376/153 |
| 5,135,704 | A | * | 8/1992 | Shefer et al. | 376/108 |
| 5,200,626 | A | * | 4/1993 | Schultz et al. | 250/390.04 |

(Continued)

FOREIGN PATENT DOCUMENTS

| | | | |
|---|---|---|---|
| JP | 02-156200 | * | 6/1990 |
| JP | 04-504472 | * | 8/1992 |

(Continued)

OTHER PUBLICATIONS

Rose and Clark. "Plasmas and Controlled Fusion," Chapter 15, MIT Press 1961.*

(Continued)

*Primary Examiner* — Jack W Keith
*Assistant Examiner* — Sean P Burke
(74) *Attorney, Agent, or Firm* — Foley & Lardner LLP

(57) ABSTRACT

The invention provides a compact high energy proton source useful for medical isotope production and for other applications including transmutation of nuclear waste. The invention further provides a device that can be used to generate high fluxes of isotropic neutrons by changing fuel types. The invention further provides an apparatus for the generation of isotopes including but not limited to $^{18}F$, $^{11}C$, $^{15}O$, $^{63}Zn$, $^{124}I$, $^{133}Xe$, $^{111}In$, $^{125}I$, $^{131}I$, $^{99}Mo$, and $^{13}N$.

13 Claims, 21 Drawing Sheets

(56) References Cited

U.S. PATENT DOCUMENTS

| | | | | | |
|---|---|---|---|---|---|
| 5,481,105 | A * | 1/1996 | Gold | 250/266 |
| 5,838,759 | A * | 11/1998 | Armistead | 378/57 |
| 5,973,328 | A * | 10/1999 | Hiller et al. | 250/390.01 |
| 6,122,921 | A * | 9/2000 | Brezoczky et al. | 62/55.5 |
| 2002/0171042 | A1* | 11/2002 | Chen et al. | 250/390.04 |
| 2003/0152185 | A1* | 8/2003 | Catalasan | 376/107 |
| 2003/0152186 | A1* | 8/2003 | Jurczyk et al. | 376/109 |
| 2003/0165213 | A1* | 9/2003 | Maglich | 376/159 |
| 2003/0201394 | A1* | 10/2003 | Peoples | 250/336.1 |
| 2005/0061994 | A1* | 3/2005 | Amini | 250/492.1 |
| 2005/0220247 | A1 | 10/2005 | Ruddy et al. | |
| 2006/0163487 | A1* | 7/2006 | Ambrosi et al. | 250/390.01 |
| 2008/0002810 | A1* | 1/2008 | Slaughter et al. | 378/57 |
| 2008/0240329 | A1* | 10/2008 | Norman et al. | 376/154 |
| 2009/0262882 | A1* | 10/2009 | Perticone et al. | 376/154 |
| 2009/0302231 | A1* | 12/2009 | McGregor et al. | 250/390.03 |
| 2010/0284502 | A1* | 11/2010 | Piefer | 376/190 |
| 2010/0294943 | A1* | 11/2010 | Frank | 250/367 |
| 2012/0286164 | A1* | 11/2012 | Piefer | 250/358.1 |

FOREIGN PATENT DOCUMENTS

| | | | |
|---|---|---|---|
| JP | 04-504472 | A | 8/1992 |
| JP | 07-249498 | * | 9/1995 |
| JP | 2003-513418 | | 4/2003 |
| JP | 2003513418 | * | 4/2003 |
| WO | WO 01/31678 | | 5/2001 |
| WO | WO0131678 | * | 5/2001 |
| WO | WO-2008/012360 | | 1/2008 |
| WO | WO2008012360 | * | 1/2008 |
| WO | WO-2009/135163 | | 11/2009 |
| WO | WO-2009/142669 | | 11/2009 |
| WO | WO2009135163 | * | 11/2009 |
| WO | WO2009142669 | * | 11/2009 |

OTHER PUBLICATIONS

Rose and Clark. "Plasma and Controlled Fusion," Chapter 15, MIT Press 1961.*

Office Action for U.S. Appl. No. 13/515,487 Dated Dec. 3, 2013, 10 pages.*

Office Action recieved for Chinese Application No. 200880125694.4 and English translation, dated Jun. 18, 2013, 13 pages.*

Office Action recieved for Japanese Application No. 2010-540933 and English translation, dated May 10, 2013, 21 pages.*

English translation of a Russian Office Action for corresponding Russian Application No. 2010126346, mail date Jun. 26, 2012, 7 pages.*

Office action received for Chinese Application No. 200880125694.4 and English translation, dated Jun. 18, 2013, 13 pages.

Office Action Received for Japanese Application No. 2010-540933 and English translation, dated May 10, 2013, 21 pages.

Office Action for Japanese Application No. 2010-540933 with English translation, dated Dec. 17, 2013, 6 pages.

Office Action for Japanese Application No. 2010-540933 with English Translation, dated May 10, 2013, 21 pages.

Office Action on U.S. Appl. No. 13/515,487 Dated Dec. 3, 2013, 10 pages.

Written Opinion for International Application No. PCT/US2010/060318, mail date Feb. 28, 2011, 6 pages.

Notice for Reasons for Rejection on Japanese Patent Application No. 2010-540933 with English translation, mail date Jun. 5, 2014, 5 pages.

Notice of Reasons for Rejection for Japanese Patent Application No. 2012-544715 with English translation, mail date Jun. 3, 2014, 8 pages.

* cited by examiner

HIGH ENERGY PROTON OR NEUTRON SOURCE

CROSS-REFERENCE TO RELATED APPLICATIONS

This application is the U.S. national stage filing of International Application No. PCT/US2008/088485, filed Dec. 29, 2008, which is incorporated herein by reference in its entirety and claims priority to U.S. Provisional Patent Application No. 61/017,288, filed Dec. 28, 2007, and U.S. Provisional Patent Application No. 61/139,985, filed Dec. 22, 2008, which are incorporated herein by reference in their entireties.

INTRODUCTION

Proton and neutron sources, such as nuclear reactors, spallation devices, cyclotrons, linacs, or existing beam-target accelerator devices, are typically used to produce short-lived radioisotopes for medical applications. These conventional sources have many disadvantages including being massive and costly structures, and producing a substantial amount of high-energy radiation that requires special shielding facilities. Shielded facilities are generally expensive and available in only a few locations. Additionally, sources, such as cyclotrons and linacs, have the disadvantage of a limited target lifetime when used as a neutron source. Few of these source facilities are located at health care facilities, making it difficult to treat patients who may benefit from use of isotopes, especially isotopes with short half-lives due to the rapid decay. When short half-life isotopes are needed, only those medical facilities with access to isotope production facilities can produce quantities significant enough to reach the patient before decaying away.

In addition to limited access, existing devices suffer from various technical problems, depending on the type of device. For solid target-based devices, the target may be damaged quickly by helium irradiation as in the case where the beam is comprised of helium particles, or the target quickly becomes loaded with deuterium as when the beam is comprised of deuterium particles. Such deuterium loading removes helium from the target (decreasing the yield quickly in time) and is a source of unwanted $^{2}H—^{2}H$ nuclear reactions, which create high energy neutrons and necessitate significant shielding. Furthermore, the number of protons that can be captured usefully in a solid target device may be limited because the protons are emitted isotropically and many will be buried deeper into the target material. In addition to short target lifetime, output of these devices may be limited due to challenges associated with keeping the target cool.

For existing gas target-based devices, limitations may include an ion beam that fails to reach full energy needed for reaction such as in IEC (inertial electrostatic confinement) devices in beam-background mode, or short lifetime of a thin window separating a high pressure target and low pressure accelerator region. Further, the background gas pressure can be critical to successful outcome. Too high or too low a pressure can cause inefficient operation, and resulting output levels may be too low to be useful for applications including medical procedures.

These and other limitations of conventional proton or neutron sources prevent isotope generation from being available to small or remote communities, and additionally require substantial capital investments for such large facilities.

SUMMARY

A high energy compact proton or neutron source embodying the principles of the invention overcomes the disadvantages of prior proton or neutron sources. The device in accordance with the invention may generate either protons or neutrons by changing the fuel type and acceleration voltage. The device includes an ion source, an accelerator, and a target system which is dimensioned and configured as a magnetic target chamber, a linear target chamber operationally coupled to a high speed synchronized pump, or a linear target chamber and an isotope extraction system. The high energy proton source in accordance with the invention may further include a high-speed pump that is synchronized with the ion source flow from the accelerator. This synchronized high speed pump prevents most material from escaping the target chamber and may obviate the need for a differential pumping system and/or allow for a smaller linear target chamber to be used.

In one aspect, the invention provides a high energy, low radiation proton source for the generation of medical isotopes. The source, in accordance with the invention, produces high energy protons (>10 MeV) through $^{2}H—^{3}He$ fusion reactions. The generated isotopes may be used in positron emission tomography (PET) diagnostic procedures as well as other imaging and treatment procedures. Specifically, the proton source in accordance with the invention may be used to generate isotopes such as $^{18}F$, $^{11}C$, $^{15}O$, $^{124}I$, and $^{13}N$. The ability to create $^{13}N$, $^{11}C$, and $^{15}O$ in a low radiation device in accordance with the invention may further facilitate the development of new imaging procedures.

In another aspect, the invention provides a high energy proton source for medical isotope generation in a device that is less expensive and more compact than conventional technologies such as cyclotrons. The high energy proton source for medical isotope generation produces minimal radiation compared to conventional technologies, minimizing or eliminating the need for special bunkers to house the generator, and thus allowing for the greater access for patients.

In yet another aspect, the invention provides a high energy proton source for medical isotope generation that can operate with a combination of high target chamber pressure and low accelerator section pressure by utilizing a specialized differential pumping system. This combination allows for high operational voltages (300 kV to 500 kV or more) while producing high output yields (>$10^{13}$ protons/sec) of high energy protons (>10 MeV). The invention may incorporate a magnetic target chamber that permits operation at lower target chamber pressures and with a smaller target chamber than conventional beam-target accelerator devices. In the magnetic target chamber, fuel ions circle the magnetic field lines, yielding a long path length in a short chamber compared to a beam that would pass in a nearly straight line through a longer chamber.

In a further aspect, the neutron source embodying the principles of the invention can generate high fluxes of isotropic neutrons. An isotropic flux of high energy neutrons may be generated by changing the fuel type from $^{2}H—^{3}He$ to $^{2}H—^{2}H$, $^{2}H—^{3}H$, or $^{3}H—^{3}H$ and adjusting the accelerator voltage accordingly. The high energy neutron source can yield materials for radiopharmaceuticals that include $^{99}Mo$ that decays into $^{99m}Tc$ (meta-stable $^{99}Tc$), which is used for medical diagnostic procedures, as well as $^{131}I$, $^{133}Xe$, $^{111}In$, and $^{125}I$.

In other aspects, the proton or neutron source in accordance with the invention may be utilized for research applications such as examination of the effects of high energy protons or neutrons irradiating a physical environment, materials, and, in the case of protons, electric and magnetic fields. The proton source in accordance with the invention may also be used in applications such as the transmutation of materials including nuclear waste, and embedding materials with protons to enhance physical properties. The neutron source may be utilized for other applications such as the transmutation of materials including nuclear waste; coloration of gemstones; irradiation of materials with neutrons to enhance physical properties; detection of clandestine materials such as nuclear weapons, explosives, drugs, and biological agents; and use of the neutron source as a driver for a subcritical reactor.

BRIEF DESCRIPTION OF THE DRAWINGS

The invention may be better understood and appreciated by reference to the detailed description of specific embodiments presented herein in conjunction with the accompanying drawings of which.

DETAILED DESCRIPTION

Figure 1:
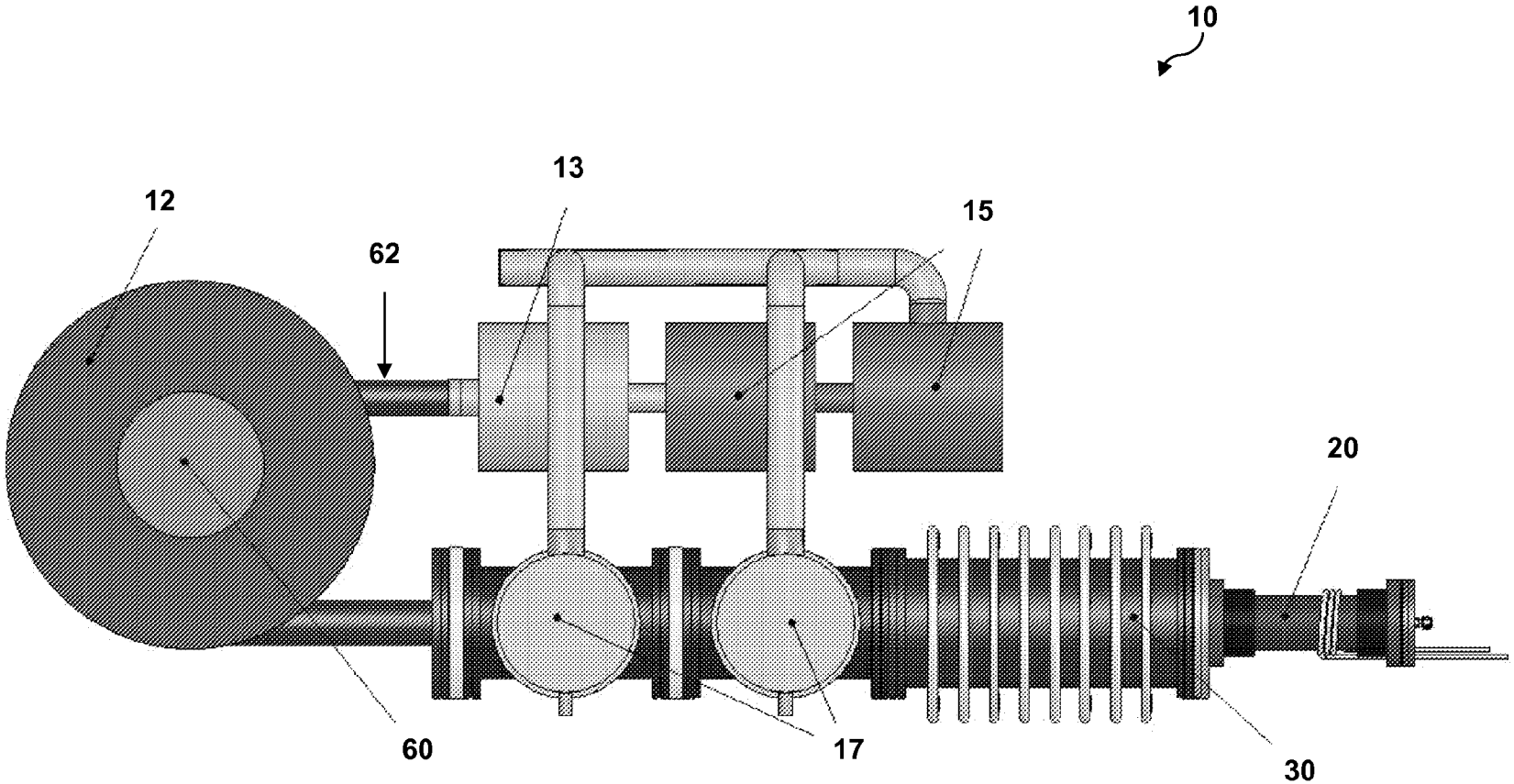
FIG. 1 is a first view of the generator with magnetic target chamber.

The invention provides a compact device that may function as a high energy proton source or a neutron source. In one embodiment, the device embodying the principles of the invention utilizes $^{2}H$—$^{3}He$ (deuterium-helium 3) fusion reactions to generate protons, which may then be used to generate other isotopes. In another embodiment, the device functions as a neutron source by changing the base reactions to $^{2}H$—$^{3}H$, $^{2}H$—$^{2}H$, or $^{3}H$—$^{3}H$ reactions.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Before explaining at least one embodiment of the invention, it is to be understood that the invention is not limited in its application to the details set forth in the following description as exemplified by the Examples. Such description and Examples are not intended to limit the scope of the invention as set forth in the appended claims. The invention is capable of other embodiments or of being practiced or carried out in various ways.

Further, no admission is made that any reference, including any patent or patent document, cited in this specification constitutes prior art. In particular, it will be understood that, unless otherwise stated, reference to any document herein does not constitute an admission that any of these documents form part of the common general knowledge in the art in the United States or in any other country. Any discussion of any references states what their authors assert, and the applicant reserves the right to challenge the accuracy and pertinency of any of the documents cited herein.

Throughout this disclosure, various aspects of this invention may be presented in a range format. It should be understood that the description in range format is merely for convenience and brevity, and should not be construed as an inflexible limitation on the scope of the invention. Accordingly, as will be understood by one skilled in the art, for any and all purposes, particularly in terms of providing a written description, all ranges disclosed herein also encompass any and all possible subranges and combinations of subranges thereof, as well as all integral and fractional numerical values within that range. As only one example, a range of 20% to 40% can be broken down into ranges of 20% to 32.5% and 32.5% to 40%, 20% to 27.5% and 27.5% to 40%, etc. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third, and upper third, etc. Further, as will also be understood by one skilled in the art, all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio. These are only examples of what is specifically intended. Further, the phrases "ranging/ranges between" a first indicate number and a second indicate number and "ranging/ranges from" a first indicate number "to" a second indicate number are used herein interchangeably.

Further, the use of "comprising," "including," "having," and variations thereof herein is meant to encompass the items listed thereafter and equivalents thereof as well as additional items, e.g., that other steps and ingredients that do not affect the final result can be added. These terms encompass the terms "consisting of" and "consisting essentially of." The use of "consisting essentially of" means that the composition or method may include additional ingredients and/or steps, but only if the additional ingredients and/or steps do not materially alter the basic and novel characteristics of the claimed composition or method.

In view of the disadvantages inherent in the conventional types of proton or neutron sources, the invention provides a novel high energy proton or neutron source that may be utilized for the production of medical isotopes. The device in accordance with the invention uses a small amount of energy to create a fusion reaction, which then creates higher energy protons or neutrons that may be used for isotope production. Using a small amount of energy may allow the device to be more compact than previous conventional devices.

The apparatus according to the invention suitably generates protons that may be used to generate other isotopes including but not limited to $^{18}F$, $^{11}C$, $^{15}O$, $^{13}N$, $^{63}Zn$, $^{124}I$ and many others. By changing fuel types, the apparatus according to the invention may also be used to generate high fluxes of isotropic neutrons that may be used to generate isotopes including but not limited to $^{131}I$, $^{133}Xe$, $^{111}In$, $^{125}I$, $^{99}Mo$ (which decays to $^{99m}Tc$) and many others. As such, the invention provides a novel compact high energy proton or neutron source for uses such as medical isotope generation that has many of the advantages over the proton or neutron sources mentioned heretofore.

In general, the invention provides an apparatus for generating protons or neutrons, which, in turn, are suitably used to generate a variety of radionuclides (or radioisotopes). The apparatus includes a plasma ion source, which may suitably be an RF-driven ion generator, an accelerator, which is suitably electrode-driven, and a target system. In the case of proton-based radioisotope production, the apparatus may also include an isotope extraction system. The RF-driven plasma ion source generates and collimates an ion beam directed along a predetermined pathway, wherein the ion source includes an inlet for entry of a first fluid. The electrode-driven accelerator receives the ion beam and accelerates the ion beam to yield an accelerated ion beam. The target system receives the accelerated ion beam. The target system contains a nuclear particle-deriving, e.g. a proton-deriving or neutron-deriving, target material that is reactive with the accelerated beam and that, in turn, emits nuclear particles, i.e., protons or neutrons. For radioisotope production, the target system may have sidewalls that are transparent to the nuclear particles. An isotope extraction system is disposed proximate or inside the target system and contains an isotope-deriving material that is reactive to the nuclear particles to yield a radionuclide (or radioisotope).

Figure 2:
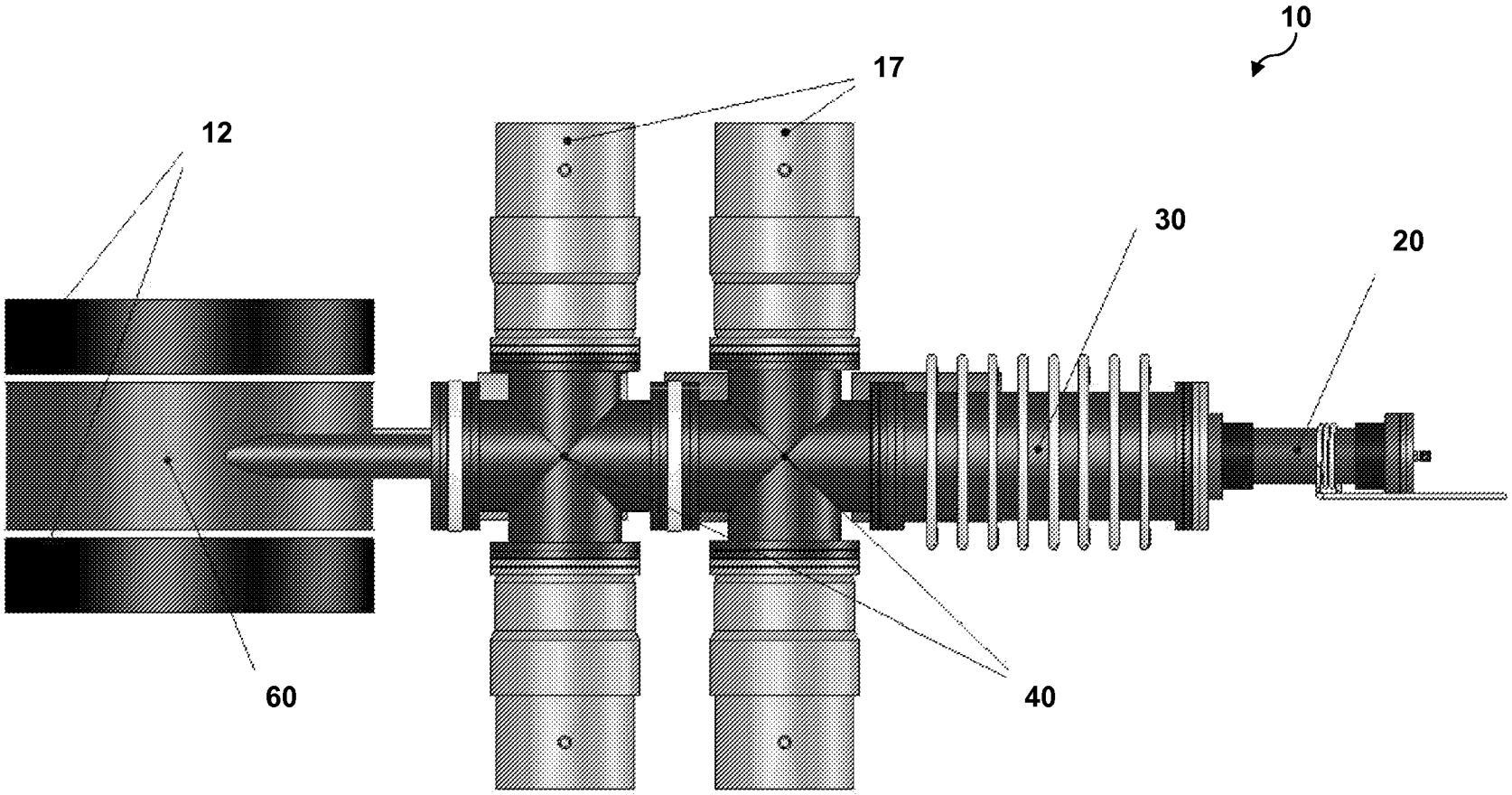
FIG. 2 is a second view of the generator with magnetic target chamber.
Figure 3:
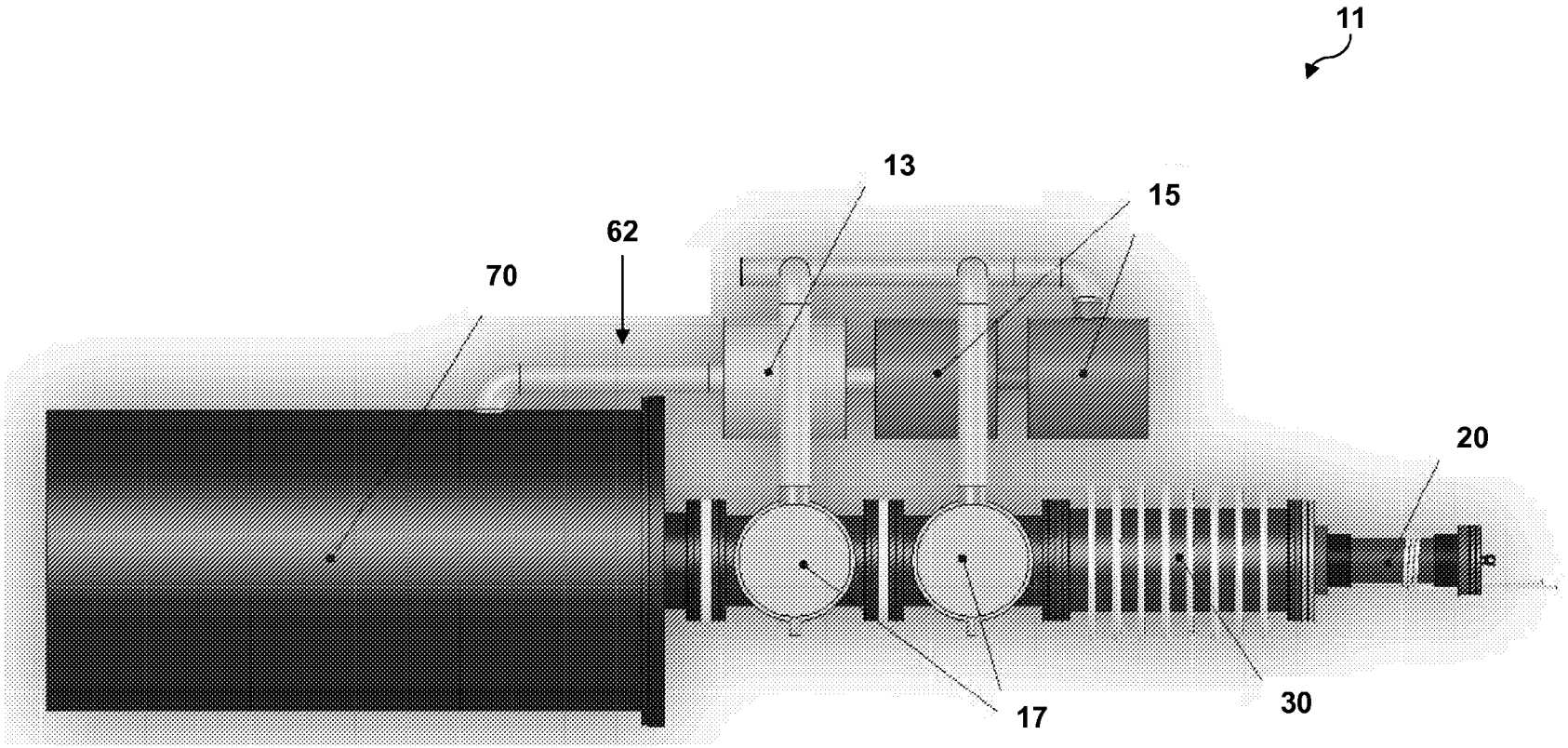
FIG. 3 is a first view of the generator with linear target chamber.

Reference is now made to the figures of the drawing. The apparatus embodying the principles of the invention is generally designated as reference numeral 10 or 11 and suitably has two configurations: a magnetic configuration 10 and a linear configuration 11. The six major sections or components of the device are connected as shown in FIG. 1 and FIG. 2 for the magnetic device, and FIG. 3 for the linear configuration. The apparatus embodying the principles of the invention 10 includes an ion source generally designated 20, an accelerator 30, a differential pumping system 40, a target system which includes a target chamber 60 or 70, an ion confinement system generally designated 80, and an isotope extraction system generally designated 90. The invention may additionally include a gas filtration system 50. The apparatus according to the invention may also include a synchronized high speed pump 100 in place of or in addition to the differential pumping system 40. Pump 100 is especially operative with the linear configuration of the target chamber.

Figure 4:
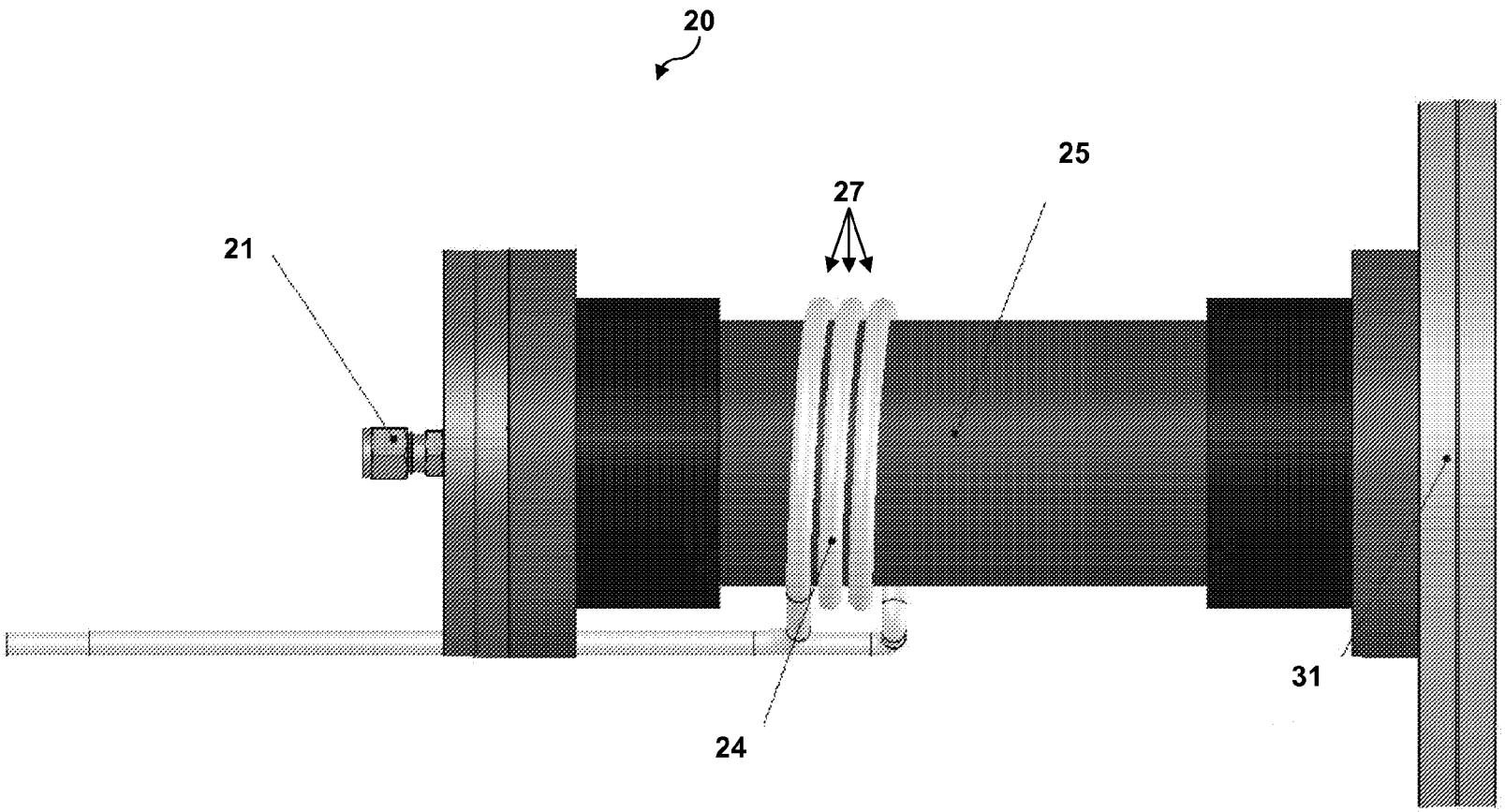
FIG. 4 is a first view of the ion source.
Figure 5:
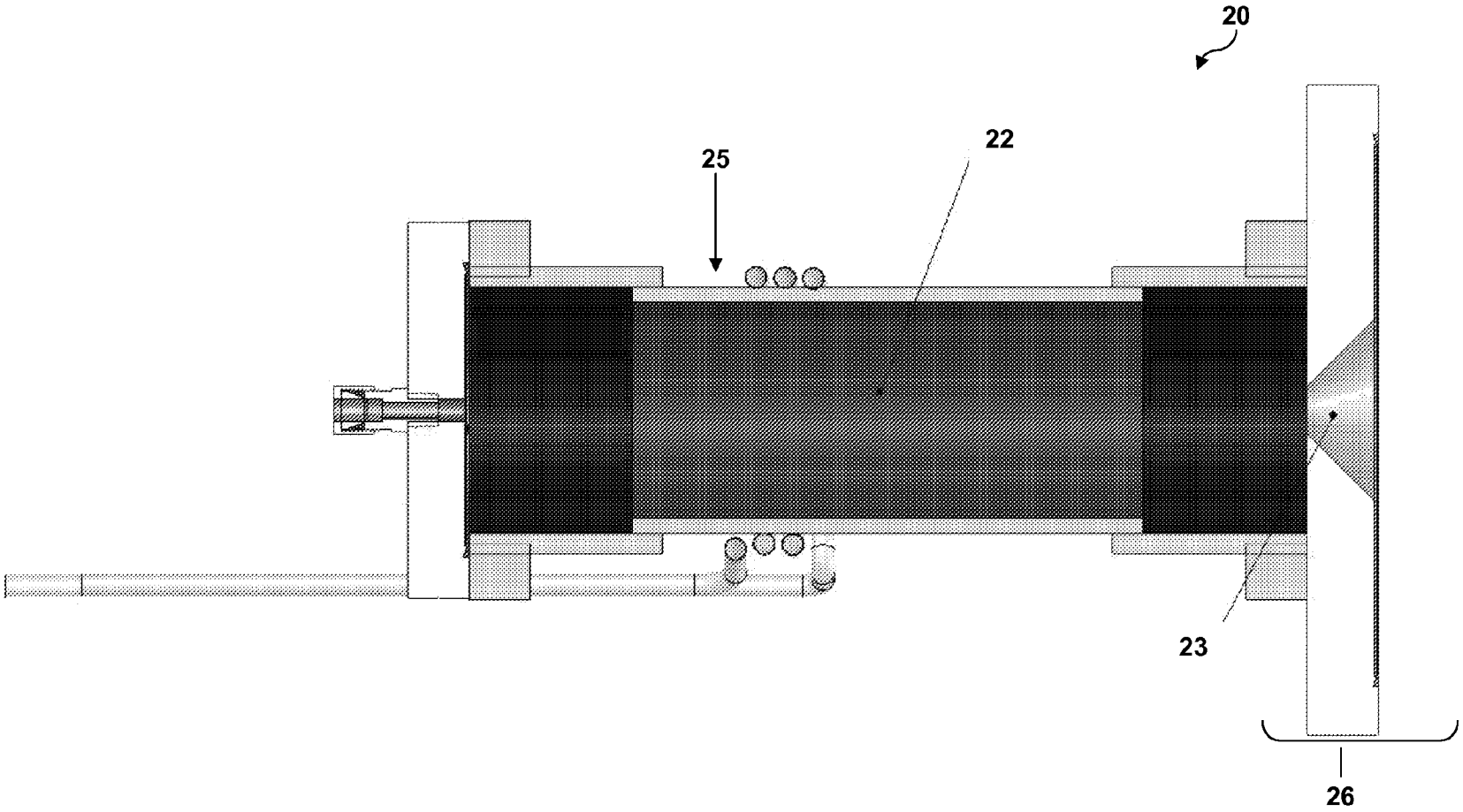
FIG. 5 is a sectional view of the ion source.
Figure 6:
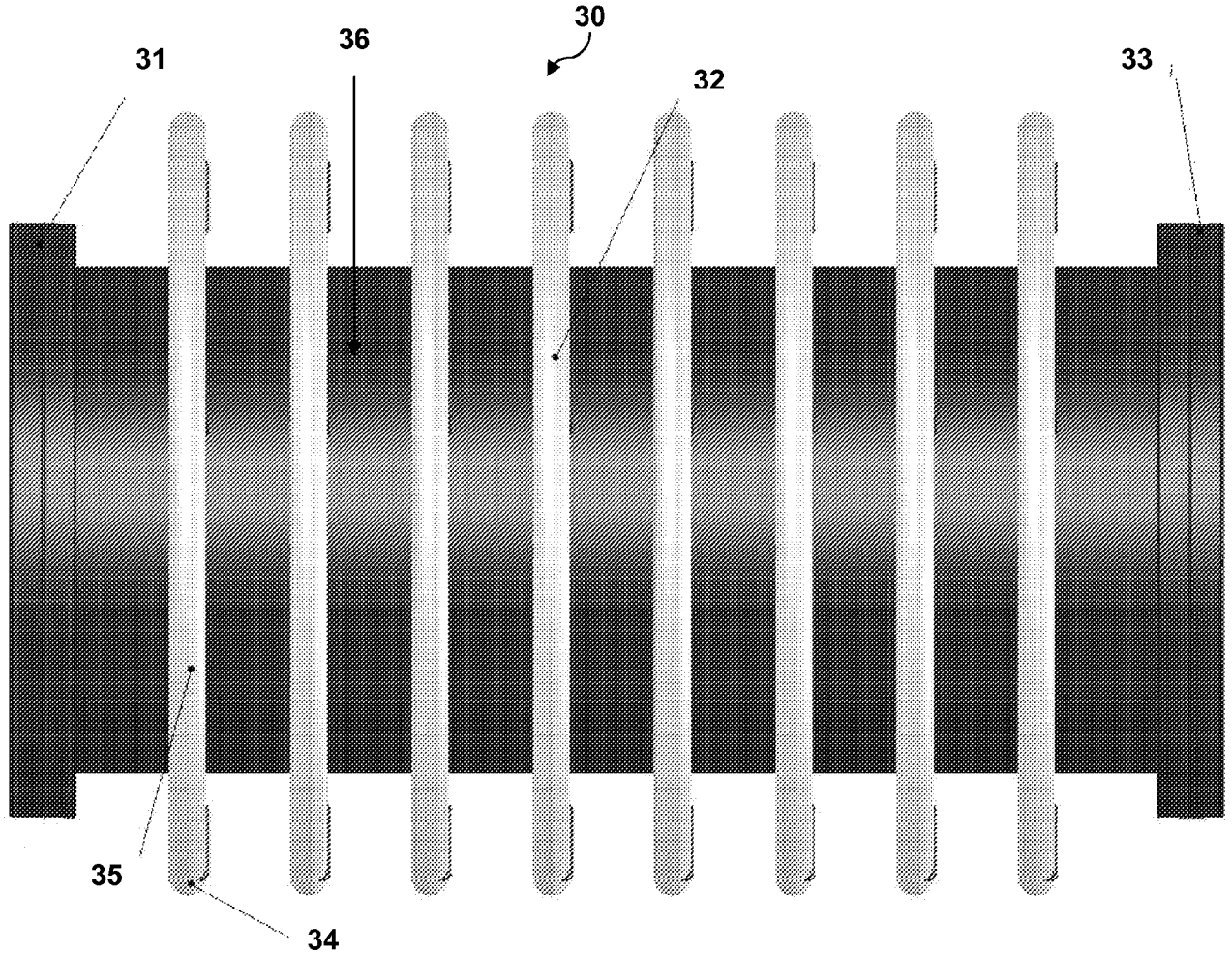
FIG. 6 is a first view of the accelerator.

The ion source 20 (FIG. 4 and FIG. 5) includes a vacuum chamber 25, a radio-frequency (RF) antenna 24, and an ion injector 26 having an ion injector first stage 23 and an ion injector final stage 35 (FIG. 6). A magnet (not shown) may be included to allow the ion source to operate in a high density helicon mode to create higher density plasma 22 to yield more ion current. The field strength of this magnet suitably ranges from about 50 G to about 6000 G, suitably about 100 G to about 5000 G. The magnets may be oriented so as to create an axial field (north-south orientation parallel to the path of the ion beam) or a cusp field (north-south orientation perpendicular to the path of the ion beam with the inner pole alternating between north and south for adjacent magnets). An axial field can create a helicon mode (dense plasma), whereas a cusp field may generate a dense plasma but not a helicon inductive mode. A gas inlet 21 is located on one end of the vacuum chamber 25, and the first stage 23 of the ion injector 26 is on the other. Gas inlet 21 provides one of the desired fuel types, which may include $^{1}H_2$, $^{2}H_2$, $^{3}H_2$, $^{3}He$, and $^{11}B$, or may comprise $^{1}H$, $^{2}H$, $^{3}H$, $^{3}He$, and $^{11}B$. The gas flow at inlet 21 is suitably regulated by a mass flow controller (not shown), which may be user or automatically controlled. RF antenna 24 is suitably wrapped around the outside of vacuum chamber 25. Alternatively, RF antenna 24 may be inside vacuum chamber 25. Suitably, RF antenna 24 is proximate the vacuum chamber such that radio frequency radiation emitted by RF antenna 24 excites the contents (i.e., fuel gas) of vacuum chamber 25, for example, forming a plasma. RF antenna 24 includes a tube 27 of one or more turns. RF tube or wire 27 may be made of a conductive and bendable material such as copper, aluminum, or stainless steel.

Ion injector 26 includes one or more shaped stages (23, 35). Each stage of the ion injector includes an acceleration electrode 32 suitably made from conductive materials that may include metals and alloys to provide effective collimation of the ion beam. For example, the electrodes are suitably made from a conductive metal with a low sputtering coefficient, e.g., tungsten. Other suitable materials may include aluminum, steel, stainless steel, graphite, molybdenum, tantalum, and others. RF antenna 24 is connected at one end to the output of an RF impedance matching circuit (not shown) and at the other end to ground. The RF impedance matching circuit may tune the antenna to match the impedance required by the generator and establish an RF resonance. RF antenna 24 suitably generates a wide range of RF frequencies, including but not limited to 0 Hz to tens of kHz to tens of MHz to GHz and greater. RF antenna 24 may be water-cooled by an external water cooler (not shown) so that it can tolerate high power dissipation with a minimal change in resistance. The matching circuit in a turn of RF antenna 24 may be connected to an RF power generator (not shown). Ion source 20, the matching circuit, and the RF power generator may be floating (isolated from ground) at the highest accelerator potential or slightly higher, and this potential may be obtained by an electrical connection to a high voltage power supply. RF power generator may be remotely adjustable, so that the beam intensity may be controlled by the user, or alternatively, by computer system. RF antenna 24 connected to vacuum chamber 25 suitably positively ionizes the fuel, creating an ion beam. Alternative means for creating ions are known by those of skill in the art and may include microwave discharge, electron-impact ionization, and laser ionization.

Figure 7:
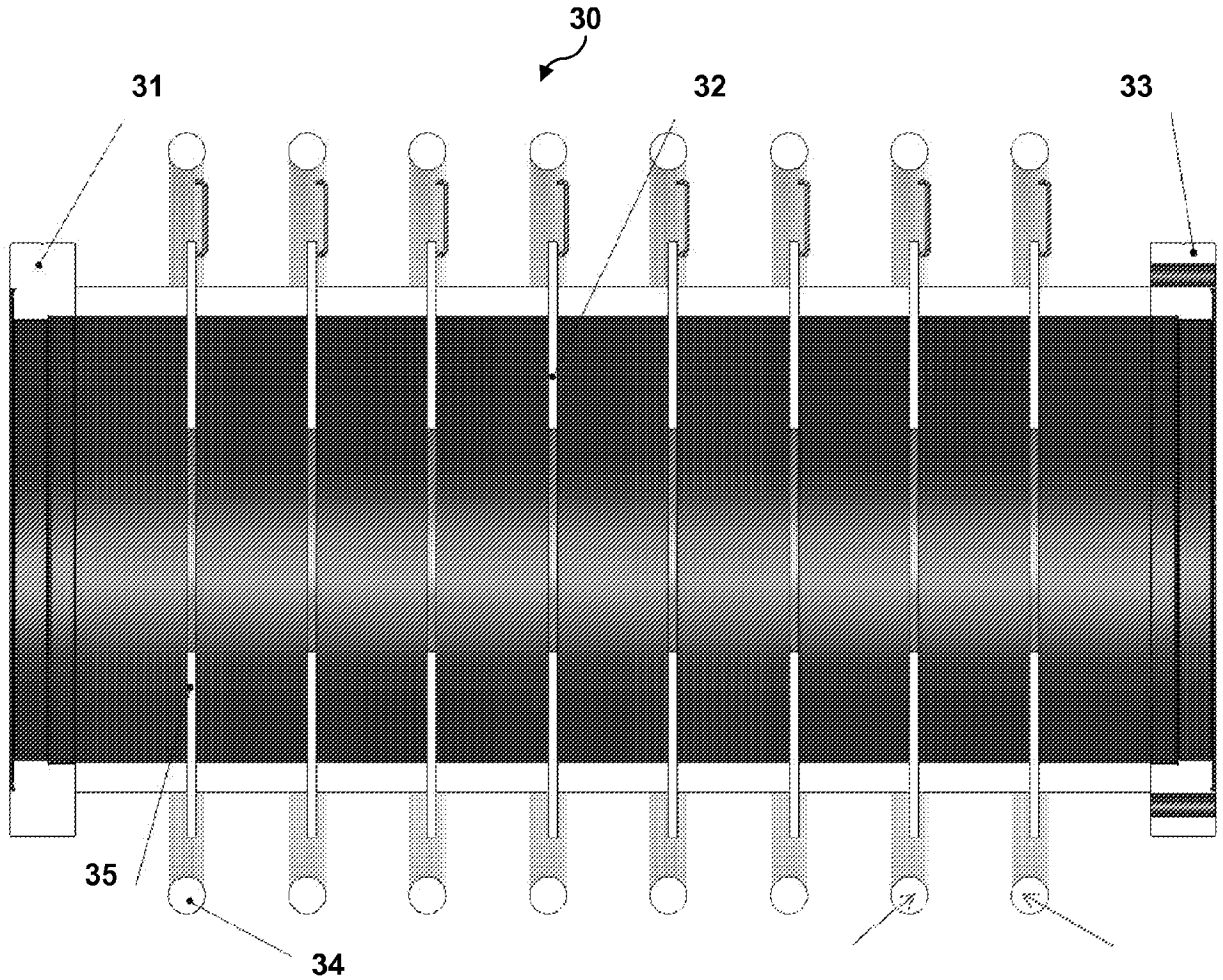
FIG. 7 is a sectional view of the accelerator.

Accelerator 30 (FIG. 6 and FIG. 7) suitably includes a vacuum chamber 36, connected at one end to ion source 20 via an ion source mating flange 31, and connected at the other end to differential pumping system 40 via a differential pumping mating flange 33. The first stage of the accelerator is also the final stage 35 of ion injector 26. At least one circular acceleration electrode 32, and suitably 3 to 50, more suitably 3 to 20, may be spaced along the axis of accelerator vacuum chamber 36 and penetrate accelerator vacuum chamber 36, while allowing for a vacuum boundary to be maintained. Acceleration electrodes 32 have holes through their centers (smaller than the bore of the accelerator chamber) and are suitably each centered on the longitudinal axis (from the ion source end to the differential pumping end) of the accelerator vacuum chamber for passage of the ion beam. The minimum diameter of the hole in acceleration electrode 32 increases with the strength of the ion beam or with multiple ion beams and may range from about 1 mm to about 20 cm in diameter, and suitably from about 1 mm to about 6 cm in diameter. Outside vacuum chamber 36, acceleration electrodes 32 may be connected to anti-corona rings 34 that decrease the electric field and minimize corona discharges. These rings may be immersed in a dielectric oil or an insulating dielectric gas such as $SF_6$. Suitably, a differential pumping mating flange 33, which facilitates connection to differential pumping section 40, is at the exit of the accelerator.

Each acceleration electrode 32 of accelerator 30 can be supplied bias either from high voltage power supplies (not shown), or from a resistive divider network (not shown) as is known by those of skill in the art. The divider for most cases may be the most suitable configuration due to its simplicity. In the configuration with a resistive divider network, the ion source end of the accelerator may be connected to the high voltage power supply, and the second to last accelerator electrode 32 may be connected to ground. The intermediate voltages of the accelerator electrodes 32 may be set by the resistive divider. The final stage of the accelerator is suitably biased negatively via the last acceleration electrode to prevent electrons from the target chamber from streaming back into accelerator 30.

In an alternate embodiment, a linac (for example, a RF quadrapole) may be used instead of an accelerator 30 as described above. A linac may have reduced efficiency and be larger in size compared to accelerator 30 described above. The linac may be connected to ion source 20 at a first end and connected to differential pumping system 40 at the other end. Linacs may use RF instead of direct current and high voltage to obtain high particle energies, and they may be constructed as is known in the art.

Figure 8:
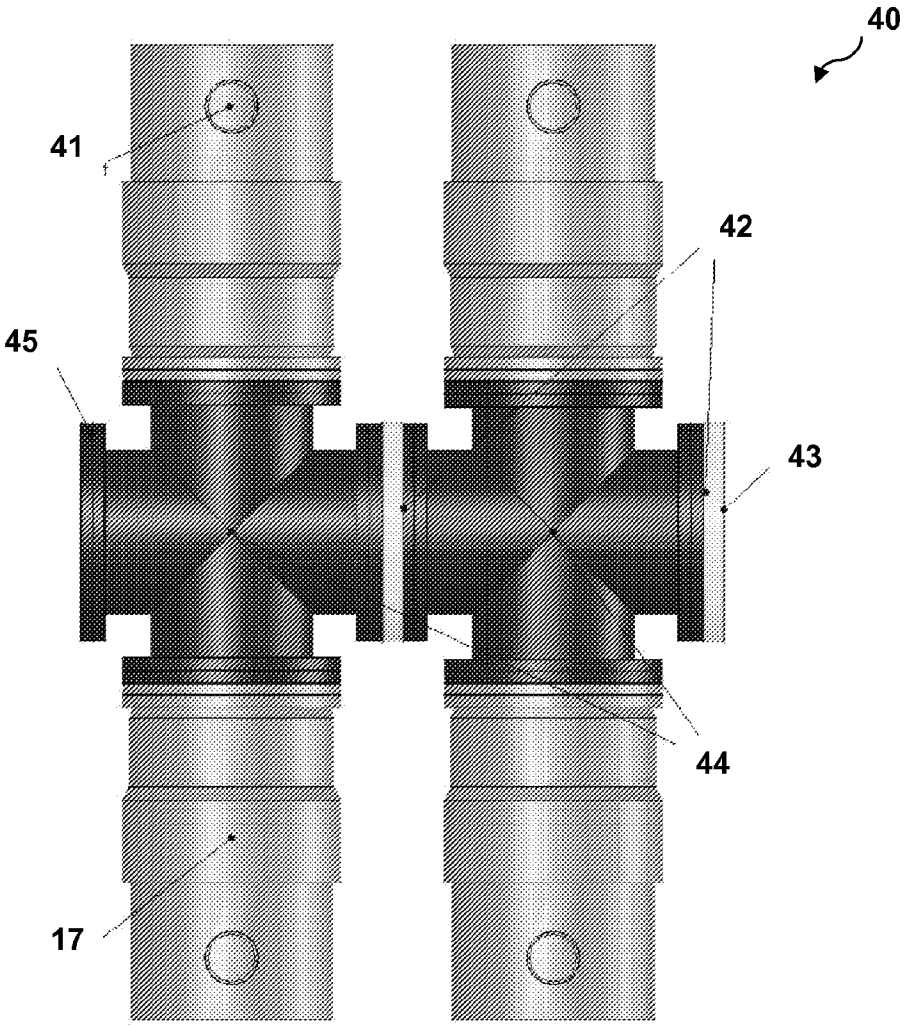
FIG. 8 is a first view of the differential pumping.
Figure 9:
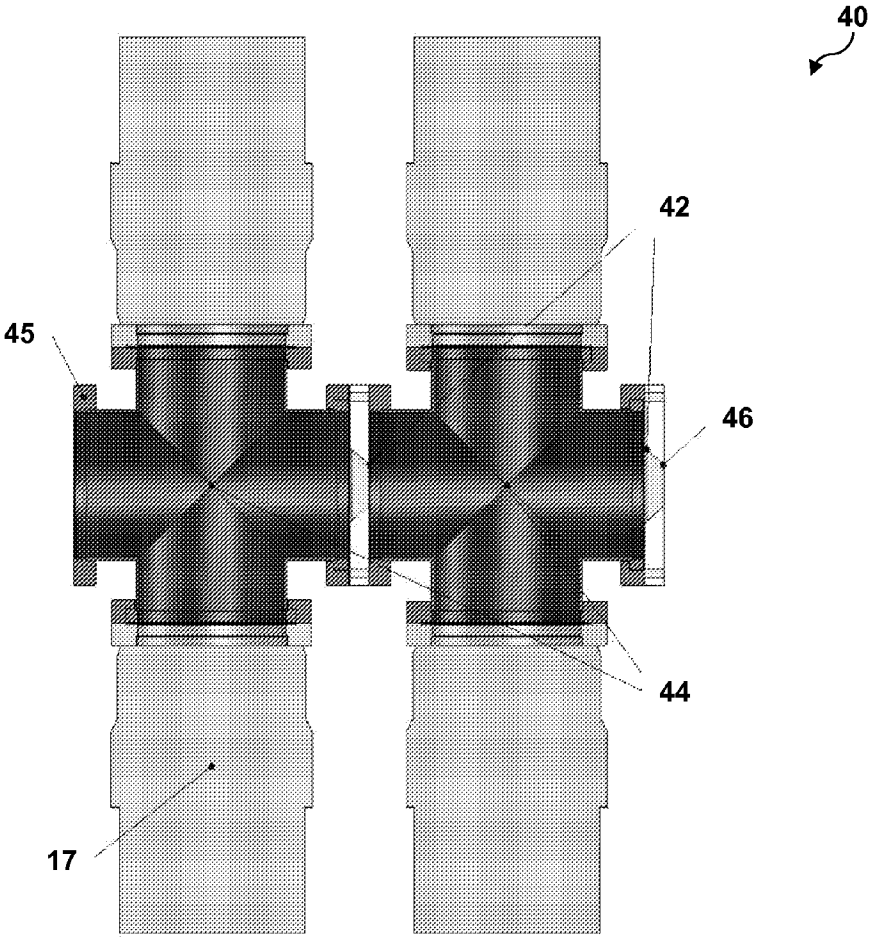
FIG. 9 is a sectional view of the differential pumping.

Differential pumping system 40 (FIG. 8 and FIG. 9) includes pressure reducing barriers 42 that suitably separate differential pumping system 40 into at least one stage. Pressure reducing barriers 42 each suitably include a thin solid plate or one or more long narrow tubes, typically 1 cm in diameter with a small hole in the center, suitably about 1 mm to about 20 cm in diameter, and more suitably about 1 mm to about 6 cm. Each stage comprises a vacuum chamber 44, associated pressure reducing barriers 42, and vacuum pumps 17, each with a vacuum pump exhaust 41. Each vacuum chamber 44 may have 1 or more, suitably 1 to 4, vacuum pumps 17, depending on whether it is a 3, 4, 5, or 6 port vacuum chamber 44. Two of the ports of the vacuum chamber 44 are suitably oriented on the beamline and used for ion beam entrance and exit from differential pumping system 40. The ports of each vacuum chamber 44 may also be in the same location as pressure reducing barriers 42. The remaining ports of each vacuum chamber 44 are suitably connected by conflat flanges to vacuum pumps 17 or may be connected to various instrumentation or control devices. The exhaust from vacuum pumps 17 is fed via vacuum pump exhaust 41 into an additional vacuum pump or compressor if necessary (not shown) and fed into gas filtration system 50. Alternatively, if needed, this additional vacuum pump may be located in between gas filtration system 50 and target chamber 60 or 70. If there is an additional compression stage, it may be between vacuum pumps 17 and filtration system 50. Differential pumping section is connected at one end to the accelerator 30 via an accelerator mating flange 45, and at the other at beam exit port 46 to target chamber (60 or 70) via a target chamber mating flange 43. Differential pumping system 40 may also include a turbulence generating apparatus (not shown) to disrupt laminar flow. A turbulence generating apparatus may restrict the flow of fluid and may include surface bumps or other features or combinations thereof to disrupt laminar flow. Turbulent flow is typically slower than laminar flow and may therefore decrease the rate of fluid leakage from the target chamber into the differential pumping section.

Figure 10:
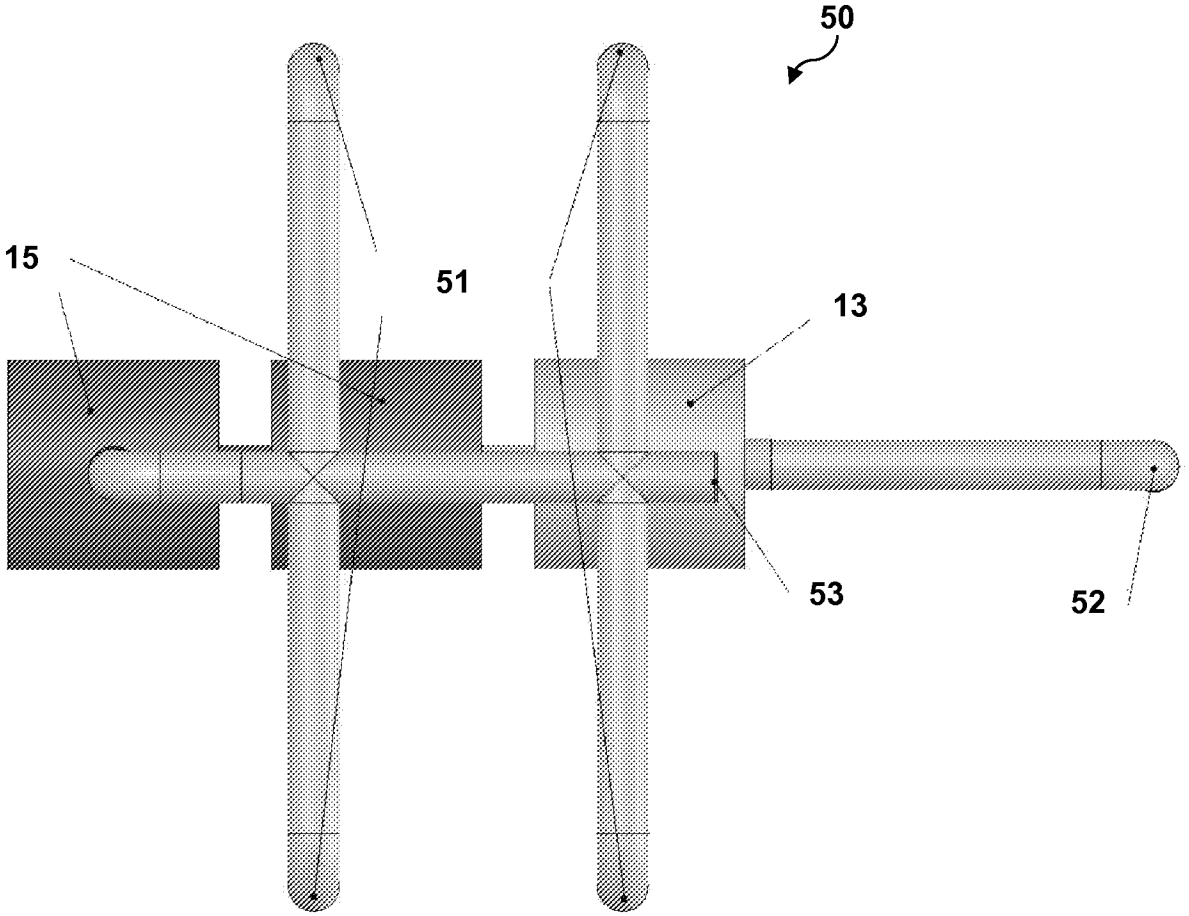
FIG. 10 is a first view of the gas filtration system.

Gas filtration system 50 is suitably connected at its vacuum pump isolation valves 51 to vacuum pump exhausts 41 of differential pumping system 40 or to additional compressors (not shown). Gas filtration system 50 (FIG. 10) includes one or more pressure chambers or "traps" (13, 15) over which vacuum pump exhaust 41 flows. The traps suitably capture fluid impurities that may escape the target chamber or ion source, which, for example, may have leaked into the system from the atmosphere. The traps may be cooled to cryogenic temperatures with liquid nitrogen (LN traps, 15). As such, cold liquid traps 13, 15 suitably cause gas such as atmospheric contaminants to liquefy and remain in traps 13, 15. After flowing over one or more LN traps 15 connected in series, the gas is suitably routed to a titanium getter trap 13, which absorbs contaminant hydrogen gasses such as deuterium that may escape the target chamber or the ion source and may otherwise contaminate the target chamber. The outlet of getter trap 13 is suitably connected to target chamber 60 or 70 via target chamber isolation valve 52 of gas filtration system 50. Gas filtration system 50 may be removed altogether from device 10, if one wants to constantly flow gas into the system and exhaust it out vacuum pump exhaust 41, to another vacuum pump exhaust (not shown), and to the outside of the system. Without gas filtration system 50, operation of apparatus 10 would not be materially altered. Apparatus 10, functioning as a neutron source, may not include getter trap 13 of gas filtration system 50.

Vacuum pump isolation valves 51 and target chamber isolation valves 52 may facilitate gas filtration system 50 to be isolated from the rest of the device and connected to an external pump (not shown) via pump-out valve 53 when the traps become saturated with gas. As such, if vacuum pump isolation valves 51 and target chamber isolation valves 52 are closed, pump-out valves 53 can be opened to pump out impurities.

Figure 11:
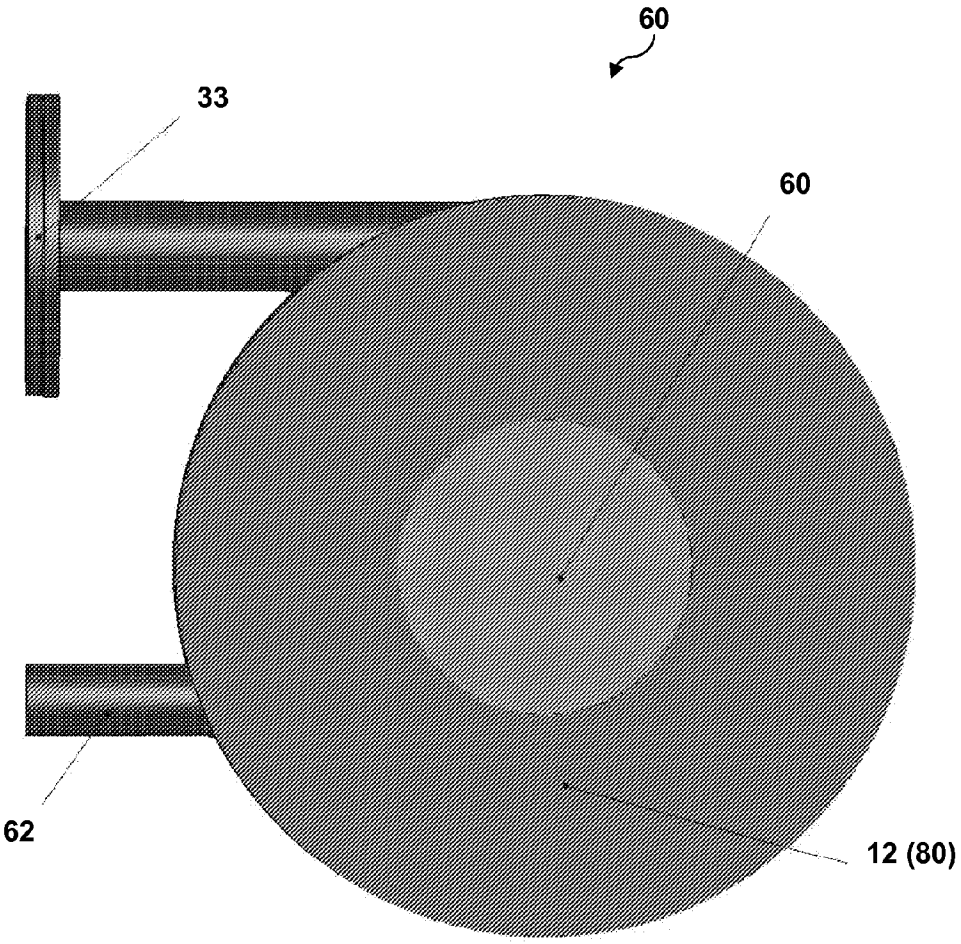
FIG. 11 is a first view of the magnetic target chamber.
Figure 12:
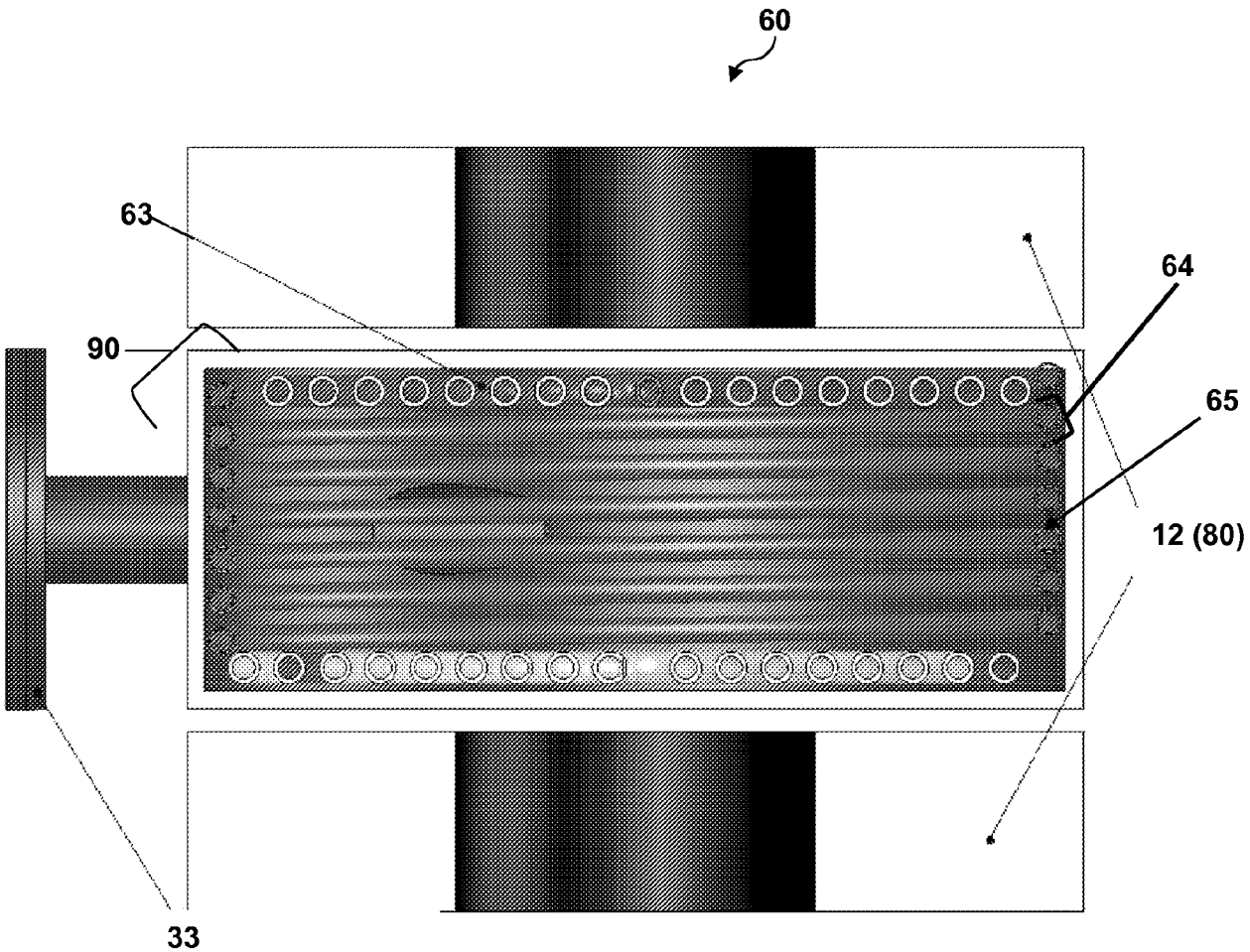
FIG. 12 is a sectional view of the magnetic target chamber.
Figure 13:
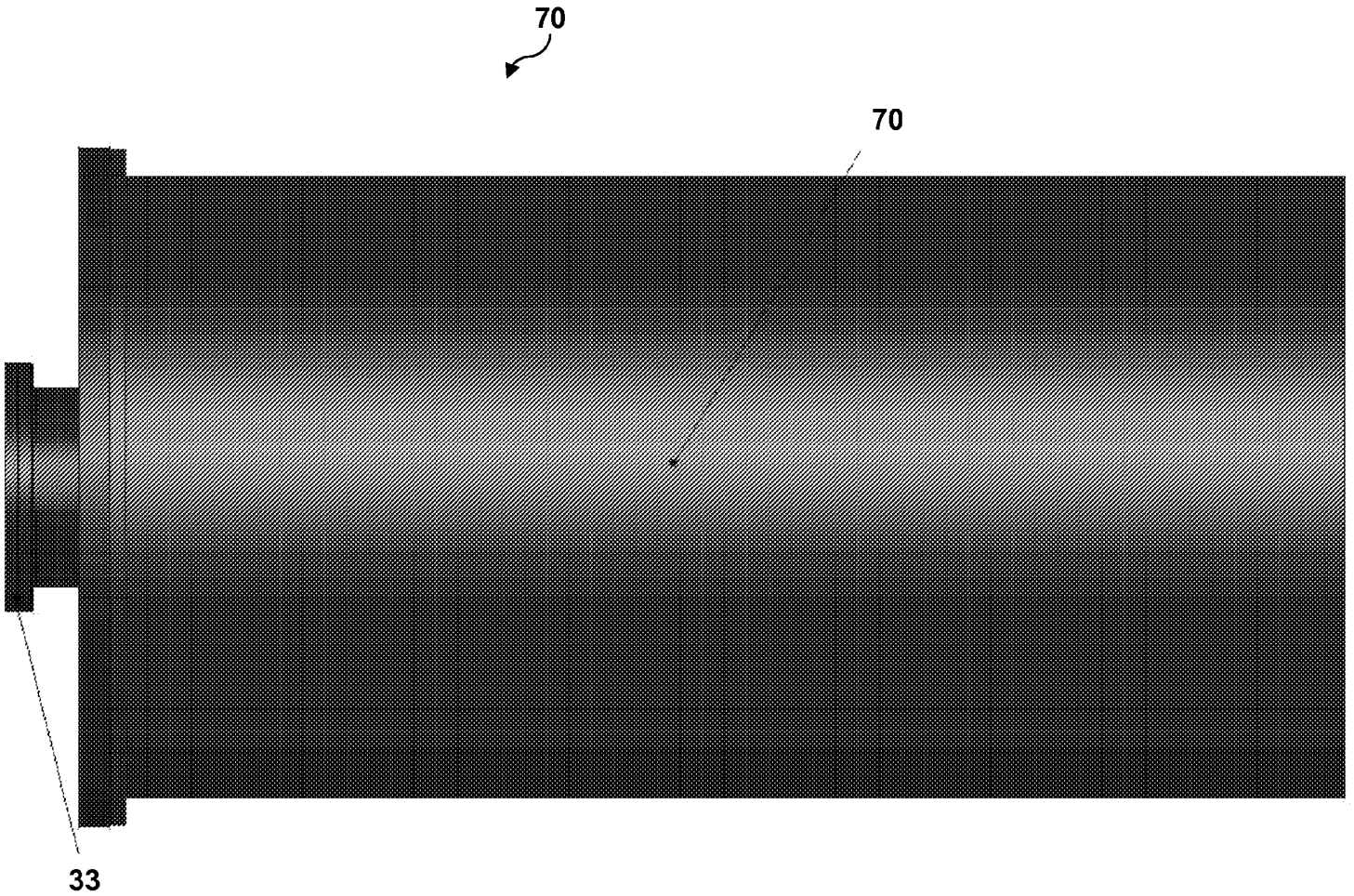
FIG. 13 is a first view of the linear target chamber.
Figure 14:
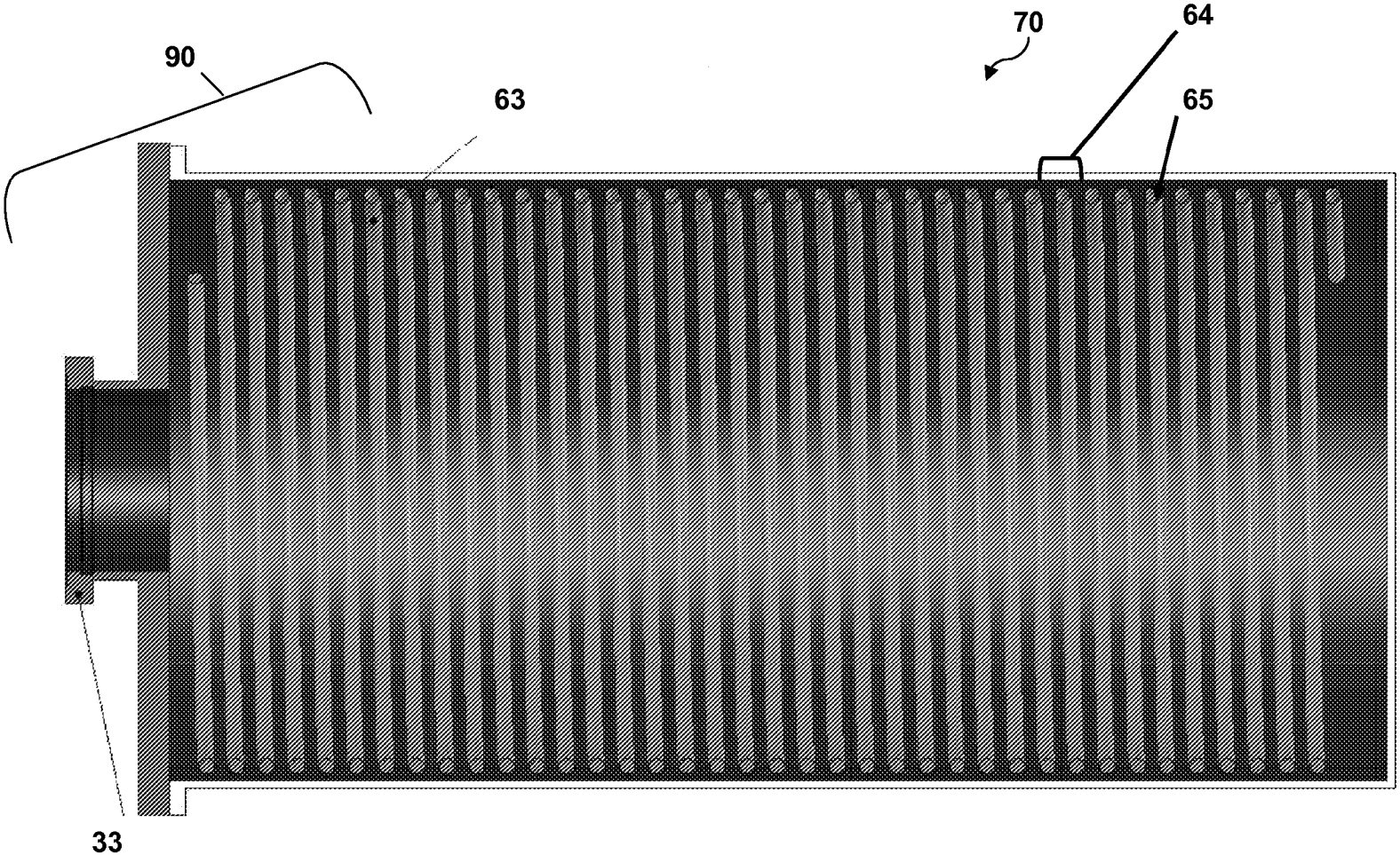
FIG. 14 is a sectional view of the linear target chamber, showing an exemplary isotope generation system for $^{18}F$ and $^{13}N$ production.

Target chamber 60 (FIG. 11 and FIG. 12 for magnetic system 10) or target chamber 70 (FIG. 13 and FIG. 14 for the linear system 11) may be filled with the target gas to a pressure of about 0 to about 100 torr, about 100 mtorr to about 30 torr, suitably about 0.1 to about 10 torr, suitably about 100 mtorr to about 30 torr. The specific geometry of target chamber 60 or 70 may vary depending on its primary application and may include many variations. The target chamber may suitably be a cylinder about 10 cm to about 5 m long, and about 5 mm to about 100 cm in diameter for the linear system 14. Suitably, target chamber 70 may be about 0.1 m to about 2 m long, and about 30 to 50 cm in diameter for the linear system 14.

For the magnetic system 12, target chamber 60 may resemble a thick pancake, about 10 cm to about 1 m tall and about 10 cm to about 10 m in diameter. Suitably, the target chamber 60 for the magnetic system 12 may be about 20 cm to about 50 cm tall and approximately 50 cm in diameter. For the magnetic target chamber 60, a pair of either permanent magnets or electromagnets (ion confinement magnet 12) may be located on the faces of the pancake, outside of the vacuum walls or around the outer diameter of the target chamber (see FIG. 11 and FIG. 12). The magnets are suitably made of materials including but not limited to copper and aluminum, or superconductors or NdFeB for electromagnets. The poles of the magnets may be oriented such that they create an axial magnetic field in the bulk volume of the target chamber. The magnetic field is suitably controlled with a magnetic circuit comprising high permeability magnetic materials such as 1010 steel, mu-metal, or other materials. The size of the magnetic target chamber and the magnetic beam energy determine the field strength according to equation (1):

$$r=1.44\sqrt{E}/B \quad (1)$$

for deuterons, wherein r is in meters, E is the beam energy in eV, and B is the magnetic field strength in gauss. The magnets may be oriented parallel to the flat faces of the pancake and polarized so that a magnetic field exists that is perpendicular to the direction of the beam from the accelerator 30, that is, the magnets may be mounted to the top and bottom of the chamber to cause ion recirculation. In another embodiment employing magnetic target chamber 60, there are suitably additional magnets on the top and bottom of the target chamber to create mirror fields on either end of the magnetic target chamber (top and bottom) that create localized regions of stronger magnetic field at both ends of the target chamber, creating a mirror effect that causes the ion beam to be reflected away from the ends of the target chamber. These additional magnets creating the mirror fields may be permanent magnets or electromagnets. One end of the target chamber is operatively connected to differential pumping system 40 via differential pumping mating flange 33, and a gas recirculation port 62 allows for gas to re-enter the target chamber from gas filtration system 50. The target chamber may also include feedthrough ports (not shown) to allow for various isotope generating apparatus to be connected.

In the magnetic configuration of the target chamber 60, the magnetic field confines the ions in the target chamber. In the linear configuration of the target chamber 70, the injected ions are confined by the target gas. When used as a proton or neutron source, the target chamber may require shielding to protect the operator of the device from radiation, and the shielding may be provided by concrete walls suitably at least one foot thick. Alternatively, the device may be stored underground or in a bunker, distanced away from users, or water or other fluid may be used a shield, or combinations thereof.

Both differential pumping system 40 and gas filtration system 50 may feed into the target chamber 60 or 70. Differential pumping system 40 suitably provides the ion beam, while gas filtration system 50 supplies a stream of filtered gas to fill the target chamber. Additionally, in the case of isotope generation, a vacuum feedthrough (not shown) may be mounted to target chamber 60 or 70 to allow the isotope extraction system 90 to be connected to the outside.

Isotope extraction system 90, including the isotope generation system 63, may be any number of configurations to provide parent compounds or materials and remove isotopes generated inside or proximate the target chamber. For example, isotope generation system 63 may include an activation tube 64 that is a tightly wound helix that fits just inside the cylindrical target chamber and having walls 65. Alternatively, in the case of the pancake target chamber with an ion confinement system 80, it may include a helix that covers the device along the circumference of the pancake and two spirals, one each on the top and bottom faces of the pancake, all connected in series. Walls 65 of activation tubes 64 used in these configurations are sufficiently strong to withstand rupture, yet sufficiently thin so that protons of over 14 MeV (approximately 10 to 20 MeV) may pass through them while still keeping most of their energy. Depending on the material, the walls of the tubing may be about 0.01 mm to about 1 mm thick, and suitably about 0.1 mm thick. The walls of the tubing are suitably made of materials that will not generate neutrons. The thin-walled tubing may be made from materials such as aluminum, carbon, copper, titanium, or stainless steel. Feedthroughs (not shown) may connect activation tube 64 to the outside of the system, where the daughter or product compound-rich fluid may go to a heat exchanger (not shown) for cooling and a chemical separator (not shown) where the daughter or product isotope compounds are separated from the mixture of parent compounds, daughter compounds, and impurities.

Figure 15:
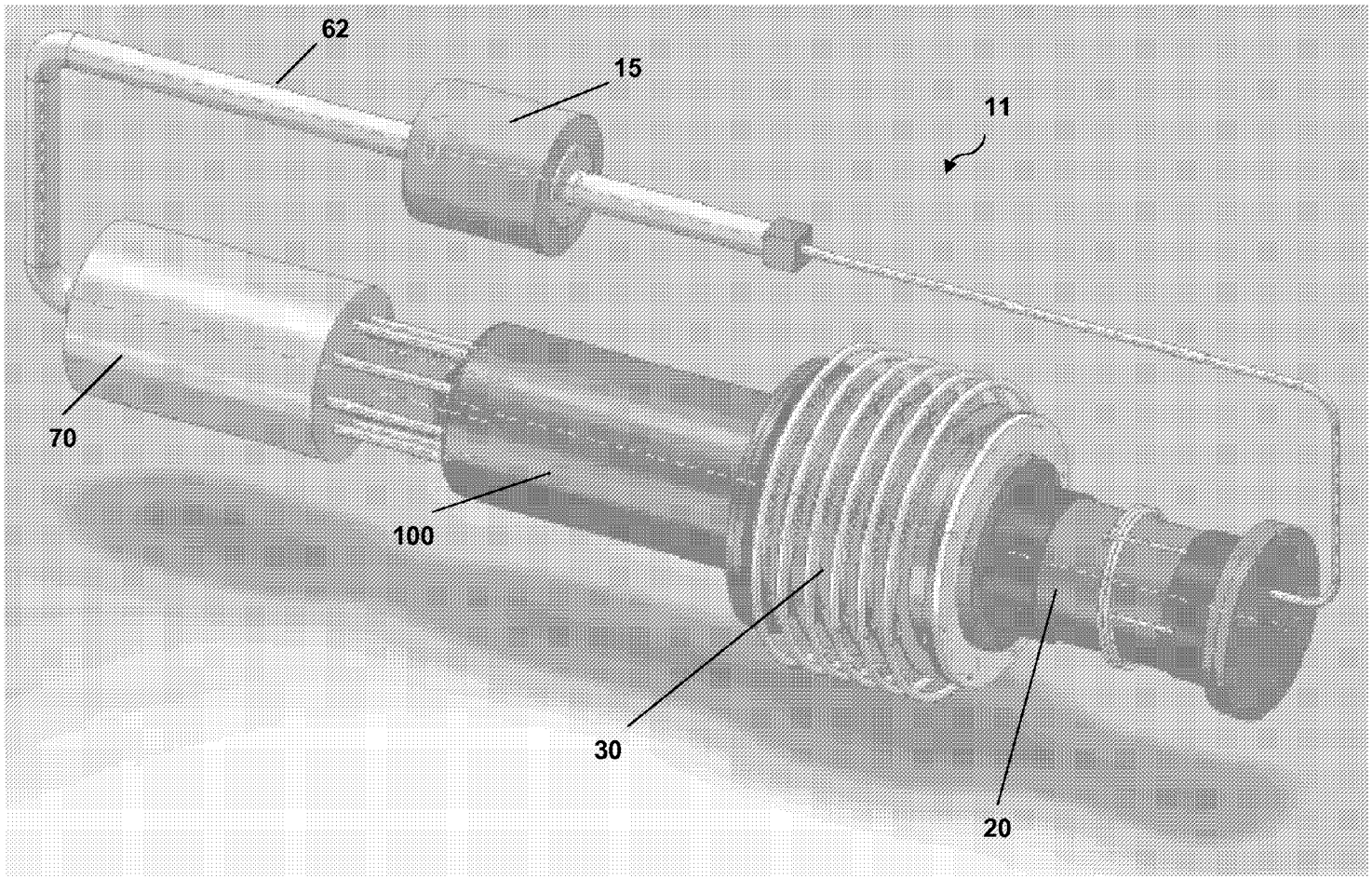
FIG. 15 is a first view of the generator with linear target chamber and synchronized high speed pump.
Figure 16:
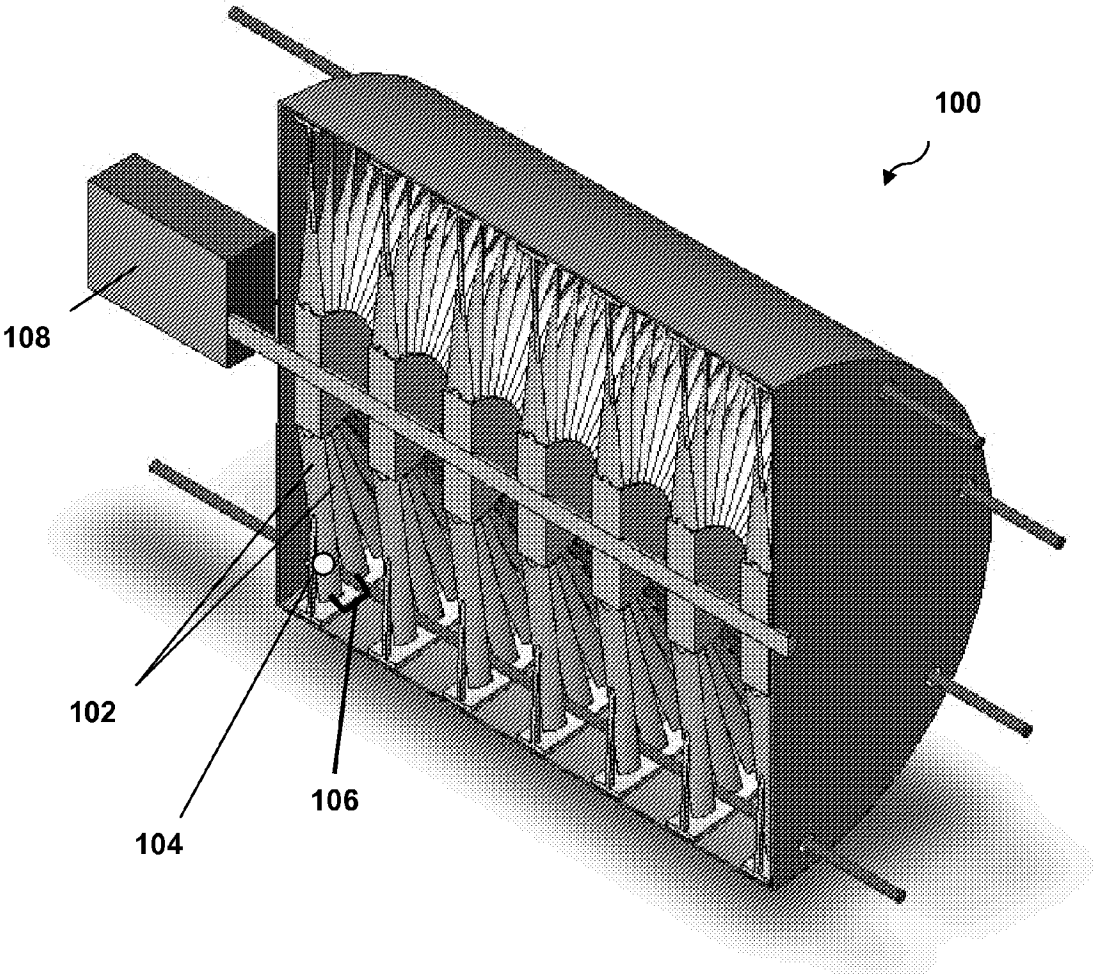
FIG. 16 is a sectional view of the synchronized high speed pump in extraction state, allowing passage of an ion beam.
Figure 17:
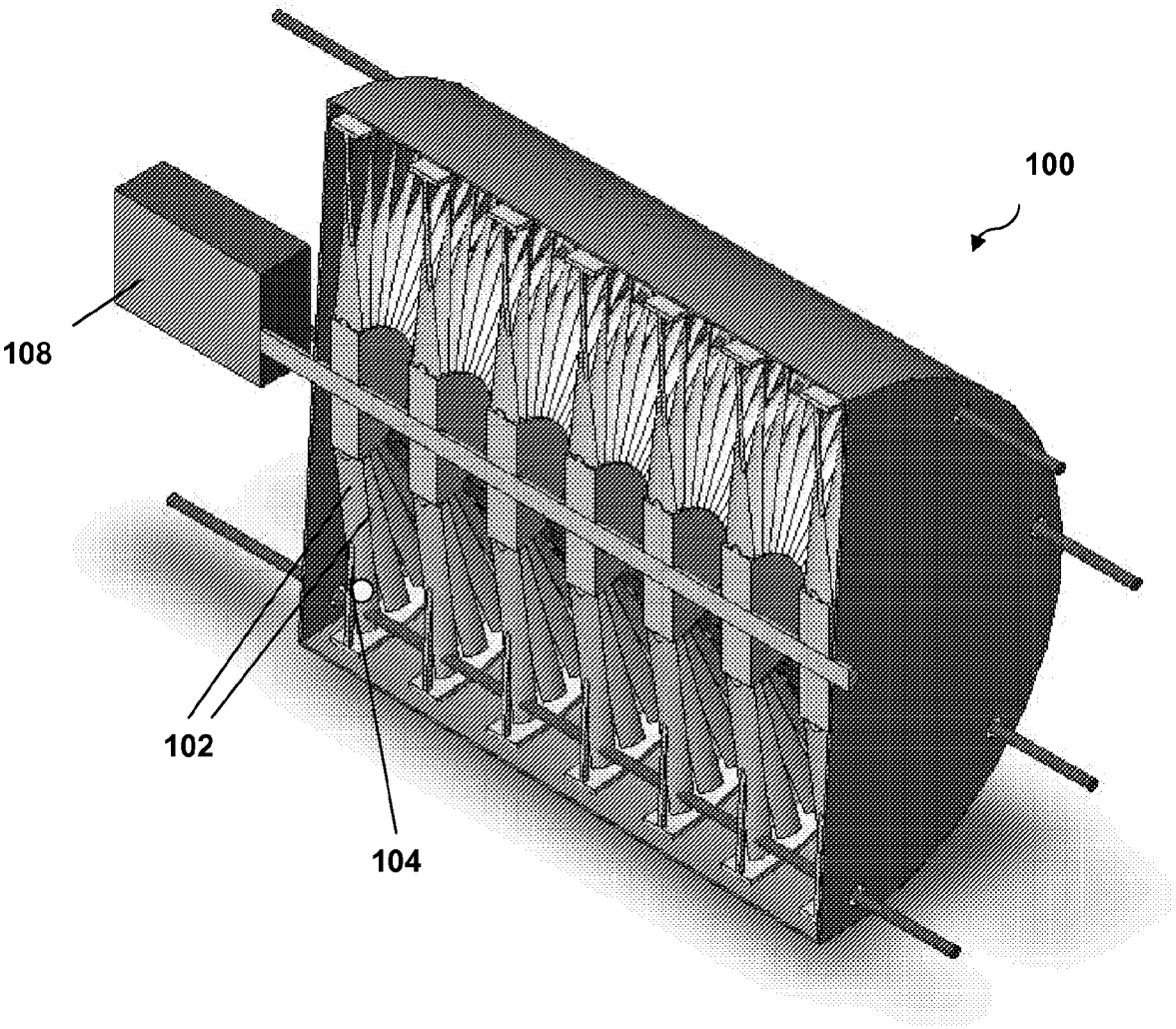
FIG. 17 is a sectional view of the synchronized high speed pump in suppression state, not allowing passage of an ion beam.
Figure 18:
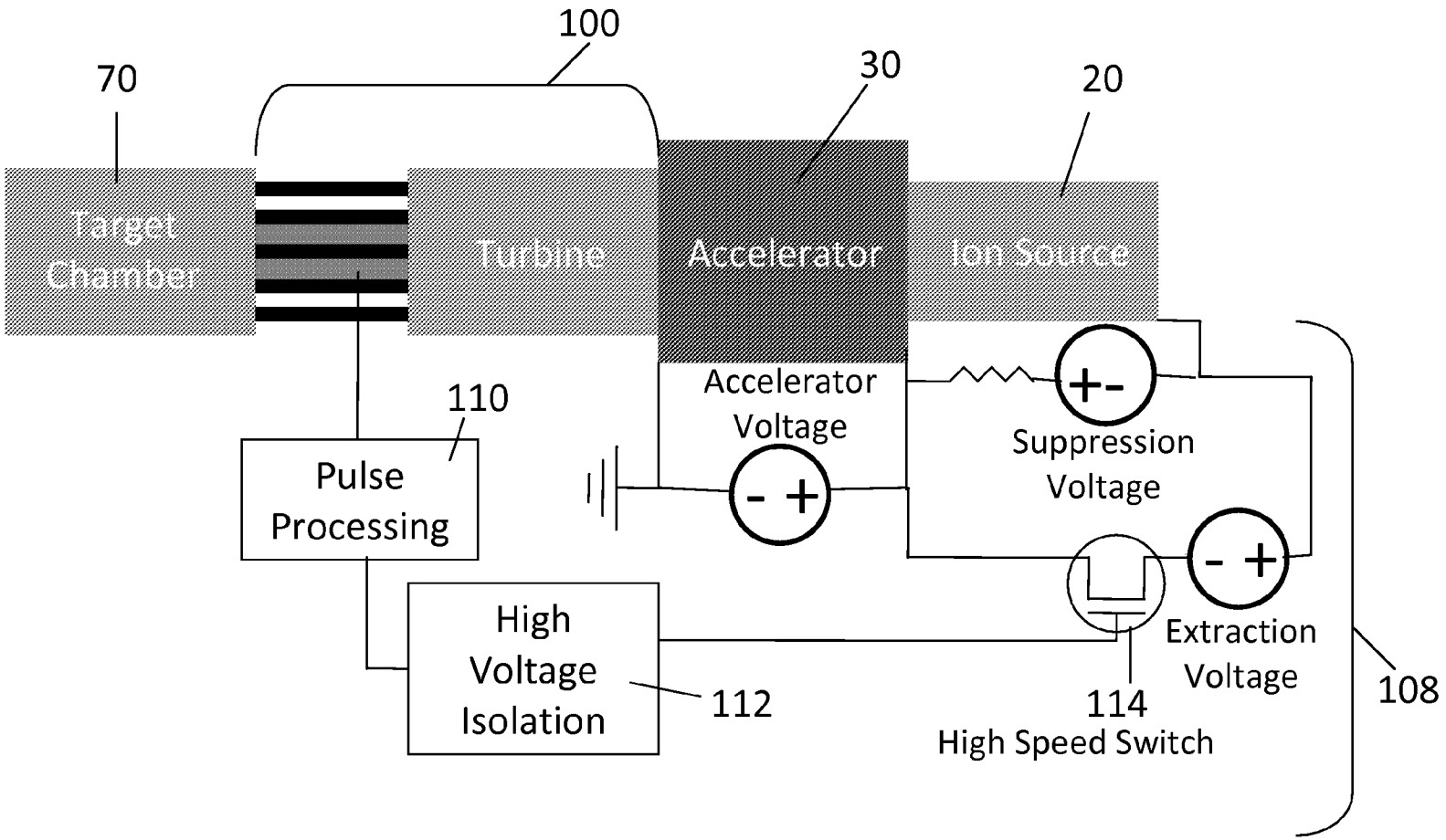
FIG. 18 is a schematic diagram of the generator with linear target chamber and synchronized high speed pump and one embodiment of controller.

In another embodiment, shown in FIG. 15, a high speed pump 100 is positioned in between accelerator 30 and target chamber 60 or 70. High speed pump 100 may replace the differential pumping system 40 and/or gas filtration system 50. The high speed pump suitably includes one or more blades or rotors 102 and a timing signal 104 that is operatively connected to a controller 108. The high speed pump may be synchronized with the ion beam flow from the accelerator section, such that the ion beam or beams are allowed to pass through at least one gap 106 in between or in blades 102 at times when gaps 106 are aligned with the ion beam. Timing signal 104 may be created by having one or more markers along the pump shaft or on at least one of the blades. The markers may be optical or magnetic or other suitable markers known in the art. Timing signal 104 may indicate the position of blades 102 or gap 106 and whether or not there is a gap aligned with the ion beam to allow passage of the ion beam from first stage 35 of accelerator 30 through high speed pump 100 to target chamber 60 or 70. Timing signal 104 may be used as a gate pulse switch on the ion beam extraction voltage to allow the ion beam to exit ion source 20 and accelerator 30 and enter high speed pump 100. When flowing through the system from ion source 20 to accelerator 30 to high speed pump 100 and to target chamber 60 or 70, the beam may stay on for a time period that the ion beam and gap 106 are aligned and then turn off before and while the ion beam and gap 106 are not aligned. The coordination of timing signal 104 and the ion beam may be coordinated by a controller 108. In one embodiment of controller 108 (FIG. 18), controller 108 may comprise a pulse processing unit 110, a high voltage isolation unit 112, and a high speed switch 114 to control the voltage of accelerator 30 between suppression voltage (ion beam off; difference may be 5-10 kV) and extraction voltage (ion beam on; difference may be 20 kv). Timing signal 104 suitably creates a logic pulse that is passed through delay or other logic or suitable means known in the art. Pulse processing unit 110 may alter the turbine of the high speed pump to accommodate for delays, and high speed switch 114 may be a MOSFET switch or other suitable switch technology known in the art. High voltage isolation unit 112 may be a fiber optic connection or other suitable connections known in the art. For example, the timing signal 104 may indicate the presence or absence of a gap 106 only once per rotation of a blade 102, and the single pulse may signal a set of electronics via controller 108 to generate a set of n pulses per blade revolution, wherein n gaps are present in one blade rotation. Alternatively, timing signal 104 may indicate the presence or absence of a gap 106 for each of m gaps during a blade rotation, and the m pulses may each signal a set of electronics via controller 108 to generate a pulse per blade revolution, wherein m gaps are present in one blade rotation. The logic pulses may be passed or coordinated via controller 108 to the first stage of accelerator section 35 (ion extractor), such that the logic pulse triggers the first stage of accelerator section 35 to change from a suppression state to an extraction state and visa versa. If the accelerator were +300 kV, for example, the first stage of accelerator 35 may be biased to +295 kV when there is no gap 106 in high speed pump 100, so that the positive ion beam will not flow from +295 kV to +300 kV, and the first stage of accelerator 35 may be biased to +310 kV when there is a gap 106 in high speed pump 100, so that the ion beam travels through accelerator 30 and through gaps 106 in high speed pump 100 to target chamber 60 or 70. The difference in voltage between the suppression and extraction states may be a relatively small change, such as about 1 kV to about 50 kV, suitably about 10 kV to about 20 kV. A small change in voltage may facilitate a quick change between suppression (FIG. 17) and extraction (FIG. 16) states. Timing signal 104 and controller 108 may operate by any suitable means known in the art, including but not limited to semiconductors and fiber optics. The period of time that the ion beam is on and off may depend on factors such as the rotational speed of blades 102, the number of blades or gaps 106, and the dimensions of the blades or gaps.

For example, the isotopes $^{18}F$ and $^{13}N$, which are utilized in PET scans, may be generated from the nuclear reactions inside the device. These isotopes can be created from their parent isotopes, $^{18}O$ (for $^{18}F$) and $^{16}O$ (for $^{13}N$) by proton bombardment. The source of the parent may be a fluid, such as water ($H_2{}^{18}O$ or $H_2{}^{18}O$), that may flow through the isotope generation system via an external pumping system (not shown) and react with the high energy protons in the target chamber to create the desired daughter compound. For the production of $^{18}F$ or $^{13}N$, water ($H_2{}^{18}O$ or $H_2{}^{16}O$, respectively) is flowed through isotope generation system 63, and the high energy protons created from the aforementioned fusion reactions may penetrate tube 64 walls and impact the parent compound and cause ($\rho$, $\alpha$) reactions producing $^{18}F$ or $^{13}N$. In a closed system, for example, the isotope-rich water may then be circulated through the heat exchanger (not shown) to cool the fluid and then into the chemical filter (not shown), such as an ion exchange resin, to separate the isotope from the fluid. The water mixture may then recirculate into target chamber (60 or 70), while the isotopes are stored in a filter, syringe, or by other suitable means known in the art until enough has been produced for imaging or other procedures.

While a tubular spiral has been described, there are many other geometries that could be used to produce the same or other radionuclides. For example, isotope generation system 63 may suitably be parallel loops or flat panel with ribs. In another embodiment, a water jacket may be attached to the vacuum chamber wall. For $^{18}F$ or $^{13}N$ creation, the spiral could be replaced by any number of thin walled geometries including thin windows, or could be replaced by a solid substance that contained a high oxygen concentration, and would be removed and processed after transmutation. Other isotopes can be generated by other means.

Before operation, target chamber 60 or 70 is suitably filled by first pre-flowing the target gas, such as $^3He$, through the ion source 20 with the power off, allowing the gas to flow through the apparatus 10 and into the target chamber. In operation, a reactant gas such as $^2H_2$ enters the ion source 20 and is positively ionized by the RF field to form plasma 22. As plasma 22 inside vacuum chamber 25 expands toward ion injector 26, plasma 22 starts to be affected by the more negative potential in accelerator 30. This causes the positively charged ions to accelerate toward target chamber 60 or 70. Acceleration electrodes 32 of the stages (23 and 35) in ion source 20 collimate the ion beam or beams, giving each a nearly uniform ion beam profile across the first stage of accelerator 30. Alternatively, the first stage of accelerator 30 may enable pulsing or on/off switching of the ion beam, as described above. As the beam continues to travel through accelerator 30, it picks up additional energy at each stage, reaching energies of up to 5 MeV, up to 1 MeV, suitably up to 500 keV, suitably 50 keV to 5 MeV, suitably 50 keV to 500 keV, and suitably 0 to 10 Amps, suitably 10 to 100 mAmps, by the time it reaches the last stage of the accelerator 30. This potential is supplied by an external power source (not shown) capable of producing the desired voltage. Some neutral gas from ion source 20 may also leak out into accelerator 30, but the pressure in accelerator 30 will be kept to a minimum by differential pumping system 40 or synchronized high speed pump 100 to prevent excessive pressure and system breakdown. The beam continues at high velocity into differential pumping 40 where it passes through the relatively low pressure, short path length stages with minimal interaction. From here it continues into target chamber 60 or 70, impacting the high density target gas that is suitably 0 to 100 torr, suitably 100 mtorr to 30 torr, suitably 5 to 20 torr, slowing down and creating nuclear reactions. The emitted nuclear particles may be about 0.3 MeV to about 30 MeV protons, suitably about 10 MeV to about 20 MeV protons, or about 0.1 MeV to about 30 MeV neutrons, suitably about 2 MeV to about 20 MeV neutrons.

In the embodiment of linear target chamber 70, the ion beam continues in an approximately straight line and impacts the high density target gas to create nuclear reactions until it stops.

In the embodiment of magnetic target chamber 60, the ion beam is bent into an approximately helical path, with the radius of the orbit (for deuterium ions, $^2H$) given by the equation (2):

$$r = \frac{204 * \sqrt{E_i}}{B} \tag{2}$$

where r is the orbital radius in cm, $E_i$ is the ion energy in eV, and B is the magnetic field strength in gauss. For the case of a 500 keV deuterium beam and a magnetic field strength of 7 kG, the orbital radius is about 20.6 cm and suitably fits inside a 25 cm radius chamber. While ion neutralization can occur, the rate at which re-ionization occurs is much faster, and the particle will spend the vast majority of its time as an ion.

Once trapped in this magnetic field, the ions orbit until the ion beam stops, achieving a very long path length in a short chamber. Due to this increased path length relative to linear target chamber 70, magnetic target chamber 60 can also operate at lower pressure. Magnetic target chamber 60, thus, may be the more suitable configuration. A magnetic target chamber can be smaller than a linear target chamber and still maintain a long path length, because the beam may recirculate many times within the same space. The fusion products may be more concentrated in the smaller chamber. As explained, a magnetic target chamber may operate at lower pressure than a linear chamber, easing the burden on the pumping system because the longer path length may give the same total number of collisions with a lower pressure gas as with a short path length and a higher pressure gas of the linac chamber.

Due to the pressure gradient between accelerator 30 and target chamber 60 or 70, gas may flow out of the target chamber and into differential pumping system 40. Vacuum pumps 17 may remove this gas quickly, achieving a pressure reduction of approximately 10 to 100 times or greater. This "leaked" gas is then filtered and recycled via gas filtration system 50 and pumped back into the target chamber, providing more efficient operation. Alternatively, high speed pump 100 may be oriented such that flow is in the direction back into the target chamber, preventing gas from flowing out of the target chamber.

If the desired product is medical isotopes, an isotope extraction system 90 as described herein is inserted into target chamber 60 or 70. This device allows the high energy protons to interact with the parent nuclide of the desired isotope. For the case of $^{18}F$ production or $^{13}N$ production, this target may be water-based ($^{16}O$ for $^{13}N$, and $^{18}O$ for $^{18}F$) and will flow through thin-walled tubing. The wall thickness is thin enough that the 14.7 MeV protons generated from the fusion reactions will pass through them without losing substantial energy, allowing them to transmute the parent isotope to the desired daughter isotope. The $^{13}N$ or $^{18}F$ rich water then is filtered and cooled via external system. Other isotopes, such as $^{124}I$ (from $^{124}Te$ or others), $^{11}C$ (from $^{14}N$ or $^{11}B$ or others), $^{15}O$ (from $^{15}N$ or others), and $^{63}Zn$, may also be generated If the desired product is protons for some other purpose, target chamber 60 or 70 may be connected to other apparatus to provide high energy protons to these applications. For example, the apparatus according to the invention may be used as an ion source for proton therapy, wherein a beam of protons is accelerated and used to irradiate cancer cells.

If the desired product is neutrons, no hardware such as isotope extraction system 90 is required, as the neutrons may penetrate the walls of the vacuum system with little attenuation. For neutron production, the fuel in the injector is changed to either deuterium or tritium, with the target material changed to either tritium or deuterium, respectively. Neutron yields of up to about $10^{15}$ neutrons/sec or more may be generated. Additionally, getter trap 13 may be removed. The parent isotope compound may be mounted around target chamber 60 or 70, and the released neutrons may convert the parent isotope compound to the desired daughter isotope compound. Alternatively, an isotope extraction system may still or additionally be used inside or proximal to the target chamber. A moderator (not shown) that slows neutrons may be used to increase the efficiency of neutron interaction. Moderators in neutronics terms may be any material or materials that slow down neutrons. Suitable moderators may be made of materials with low atomic mass that are unlikely to absorb thermal neutrons. For example, to generate $^{99}Mo$ from a $^{99}Mo$ parent compound, a water moderator may be used. $^{99}Mo$ decays to $^{99m}Tc$, which may be used for medical imaging procedures. Other isotopes, such as $^{131}I$, $^{133}Xe$, $^{111}In$, and $^{125}I$, may also be generated. When used as a neutron source, the invention may include shielding such as concrete or a fluid such as water at least one foot thick to protect the operators from radiation. Alternatively, the neutron source may be stored underground to protect the operators from radiation. The manner of usage and operation of the invention in the neutron mode is the same as practiced in the above description.

According to the invention, the fusion rate of the beam impacting a thick target gas can be calculated. The incremental fusion rate for the ion beam impacting a thick target gas is given by the equation (3):

$$df(E) = n_b * \frac{I_{ion}}{e} * \sigma(E) * dl \tag{3}$$

where df(E) is the fusion rate (reactions/sec) in the differential energy interval dE, $n_b$ is the target gas density (particles I $m^3$), $I_{ion}$ is the ion current (A), e is the fundamental charge of $1.6022*10^{-19}$ coulombs/particle, σ(E) is the energy dependent cross section ($m^2$) and dl is the incremental path length at which the particle energy is E. Since the particle is slowing down once inside the target, the particle is only at energy E over an infinitesimal path length.

Figure 19:
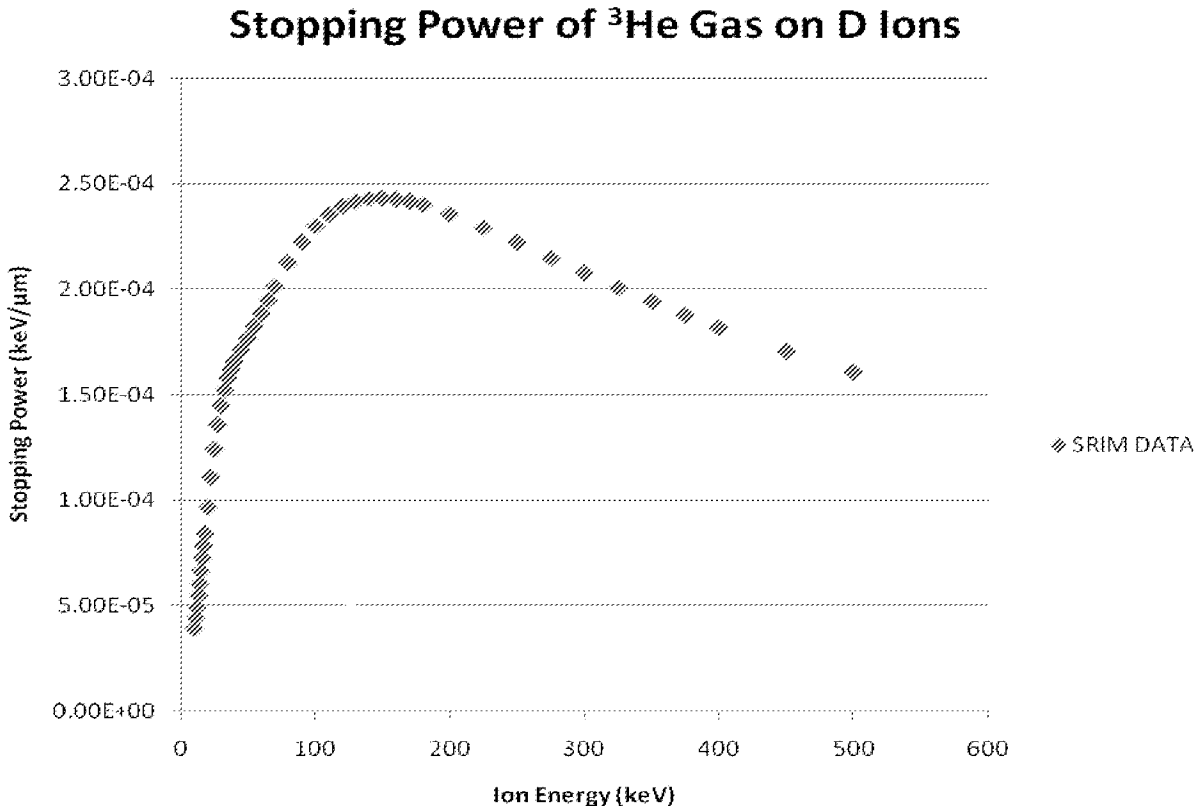
FIG. 19 is a graph of stopping power (keV/μm) versus ion energy (keV) for the stopping power of $^{3}He$ gas on $^{2}H$ ions at 10 torr gas pressure and 25° C.

To calculate the total fusion rate from a beam stopping in a gas, equation (2) is integrated over the entire particle path length from where its energy is at its maximum of $E_i$ to where it stops as shown in equation (4):

$$F(E_i) = \int_0^{E_i} n_b * \frac{I_{ion}}{e} * \sigma(E) dl = \frac{n_b I_{ion}}{e} \int_0^{E_i} \sigma(E) dl \tag{4}$$

where $F(E_i)$ is the total fusion rate for a beam of initial energy $E_i$ stopping in the gas target. To solve this equation, the incremental path length dl is solved for in terms of energy. This relationship is determined by the stopping power of the gas, which is an experimentally measured function, and can be fit by various types of functions. Since these fits and fits of the fusion cross section tend to be somewhat complicated, these integrals were solved numerically. Data for the stopping of deuterium in $^3He$ gas at 10 torr and 25° C. was obtained from the computer program Stopping and Range of Ions in Matter (SRIM; James Ziegler, www.srim.org) and is shown in FIG. 19.

Figure 20:
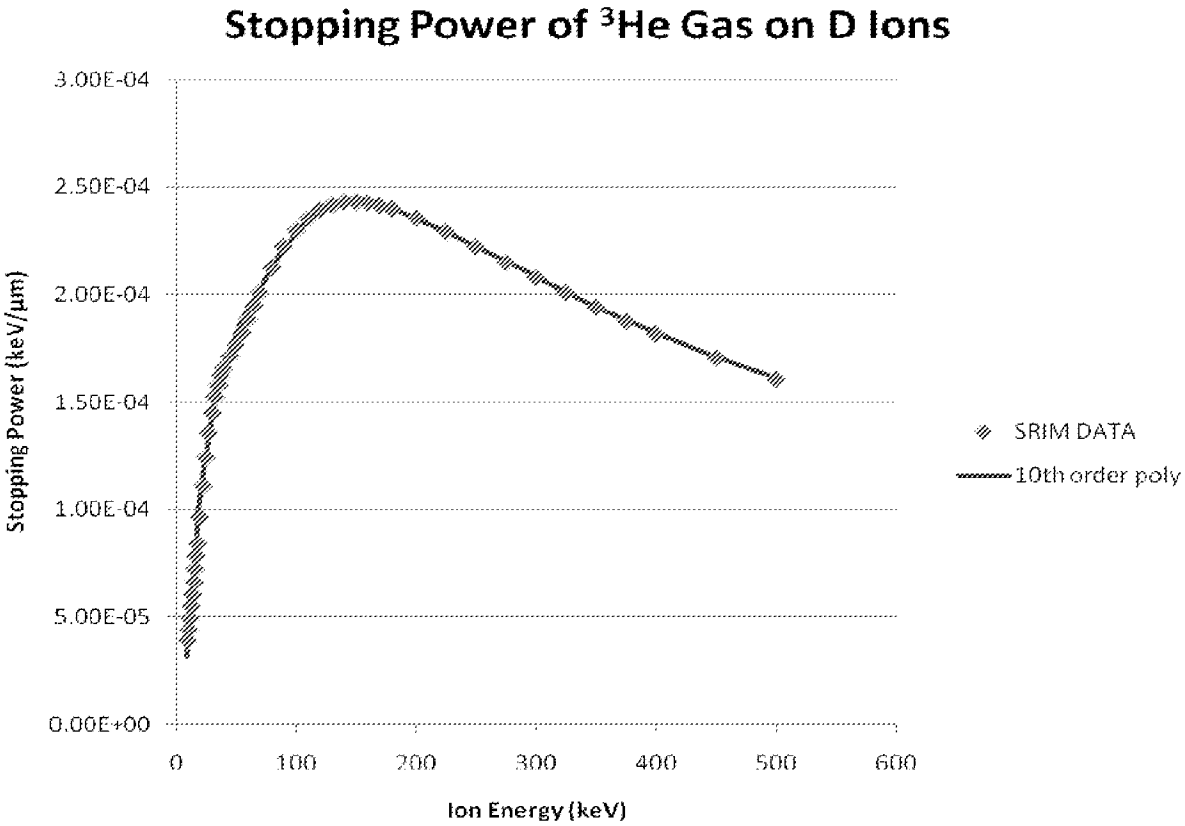
FIG. 20 is a graph of stopping power (keV/μm) versus ion energy (keV) for the stopping power of $^{3}He$ gas on $^{2}H$ ions at 10 torr gas pressure and 25° C.

An equation was used to predict intermediate values. A polynomial of order ten was fit to the data shown in FIG. 19. The coefficients are shown in TABLE 1, and resultant fit with the best-fit $10^{th}$ order polynomial is shown in FIG. 20.

TABLE 1

| Order | Coefficient |
|---|---|
| 10 | −1.416621E−27 |
| 9 | 3.815365E−24 |
| 8 | −4.444877E−21 |
| 7 | 2.932194E−18 |
| 6 | −1.203915E−15 |
| 5 | 3.184518E−13 |
| 4 | −5.434029E−11 |
| 3 | 5.847578E−09 |
| 2 | −3.832260E−07 |
| 1 | 1.498854E−05 |
| 0 | −8.529514E−05 |

As can be seen from these data, the fit was quite accurate over the energy range being considered. This relationship allowed the incremental path length, dl, to be related to an incremental energy interval by the polynomial tabulated above. To numerically solve this, it is suitable to choose either a constant length step or a constant energy step, and calculate either how much energy the particle has lost or how far it has gone in that step. Since the fusion rate in equation (4) is in terms of dl, a constant length step was the method used. The recursive relationship for the particle energy E as it travels through the target is the equation (5):

$$E_{n+1}=E_n-S(E)*dl \tag{5}$$

where n is the current step (n=0 is the initial step, and $E_o$ is the initial particle energy), $E_{n+1}$ is the energy in the next incremental step, S(E) is the polynomial shown above that relates the particle energy to the stopping power, and dl is the size of an incremental step. For the form of the incremental energy shown above, E is in keV and dl is in μm.

This formula yields a way to determine the particle energy as it moves through the plasma, and this is important because it facilitates evaluation of the fusion cross section at each energy, and allows for the calculation of a fusion rate in any incremental step. The fusion rate in the numerical case for each step is given by the equation (6):

$$f_n(E) = n_b * \frac{I_{ion}}{e} * \sigma(E_n) * dl \tag{6}$$

To calculate the total fusion rate, this equation was summed over all values of $E_n$ until E=0 (or n*dl=the range of the particle) as shown in equation (7):

$$F(E_o) = \sum_{n=0}^{n*dl=range} f_n(E) \tag{7}$$

This fusion rate is known as the "thick-target yield". To solve this, an initial energy was determined and a small step size dl chosen. The fusion rate in the interval di at full energy was calculated. Then the energy for the next step was calculated, and the process repeated. This goes on until the particle stops in the gas.

Figure 21:
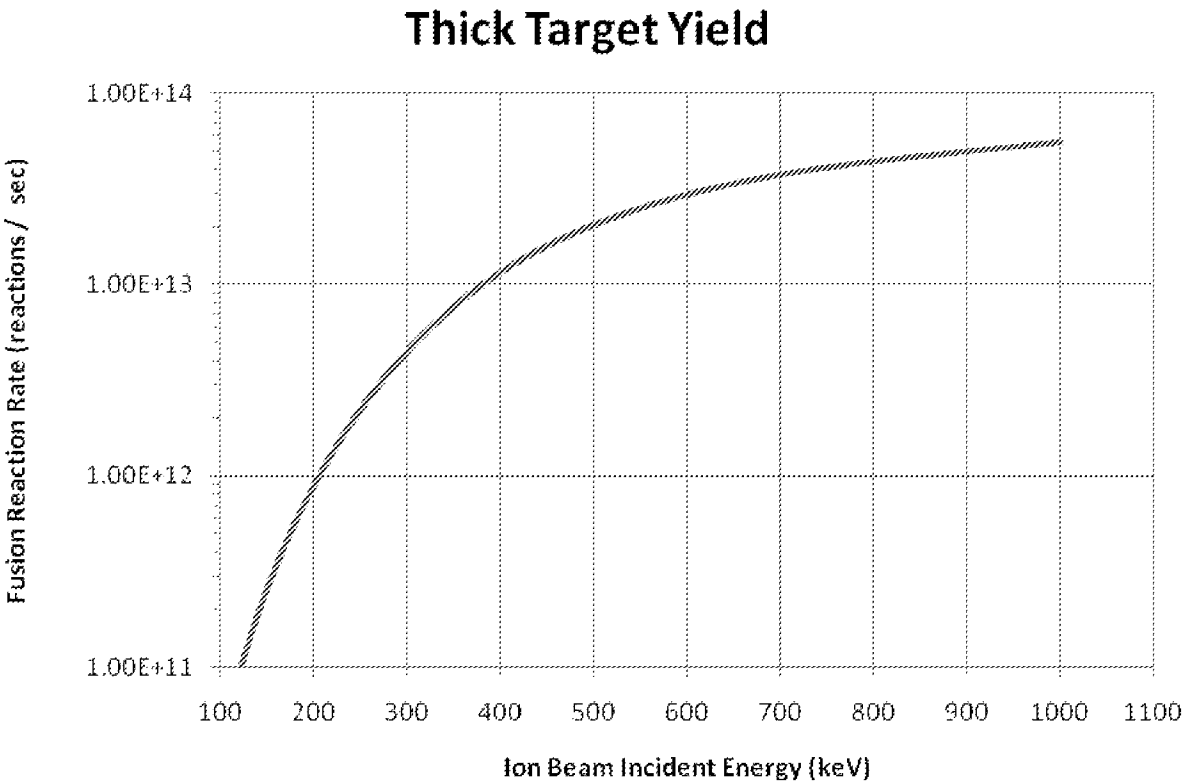
FIG. 21 is a graph of fusion reaction rate (reactions/second) versus ion beam incident energy (keV) for a 100 mA incident $^{2}H$ beam impacting a $^{3}He$ target at 10 torr.

For the case of a singly ionized deuterium beam impacting a 10 torr helium-3 gas background at room temperature, at an energy of 500 keV and an intensity of 100 mA, the fusion rate was calculated to be approximately $2\times10^{13}$ fusions/second, generating the same number of high energy protons (equivalent to 3 μA protons). This level is sufficient for the production of medical isotopes, as is known by those of skill in the art. A plot showing the fusion rate for a 100 mA incident deuterium beam impacting a helium-3 target at 10 torr is shown in FIG. 21.

The apparatus according to the invention may be used in a variety of different applications. According to the invention, the proton source may be used to transmutate materials including nuclear waste and fissile material. The invention may also be used to embed materials with protons to enhance physical properties. For example, the invention may be used for the coloration of gemstones. The invention also provides a neutron source that may be used for neutron radiography. As a neutron source, the invention may be used to detect nuclear weapons. For example, as a neutron source the apparatus may be used to detect special nuclear materials, which are materials that can be used to create nuclear explosions, such as Pu, $^{233}$U, and materials enriched with $^{233}$U or $^{235}$U. As a neutron source, the apparatus according to the invention may be used to detect underground features including but not limited to tunnels, oil wells, and underground isotopic features by creating neutron pulses and measuring the reflection and/or refraction of neutrons from materials. The invention may be used as a neutron source in neutron activation analysis (NAA), which may determine the elemental composition of materials. For example, NAA may be used to detect trace elements in the pictogram range. As a neutron source, the invention may also be used to detect materials including but not limited to clandestine materials, explosives, drugs, and biological agents by determining the atomic composition of the material. The invention may also be used as a driver for a sub-critical reactor.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

The present invention is further exemplified by the following examples, which should not be construed by way of limiting the scope of the present invention.

EXAMPLES

Example 1

Neutron Source with Magnetic Target Chamber

Initially, the system will be clean and empty, containing a vacuum of $10^{-9}$ torr or lower, and the high speed pumps will be up to speed (two stages with each stage being a turbomolecular pump). Approximately 25-30 standard cubic centimeters of gas (deuterium for producing neutrons) will be flowed into the target chamber to create the target gas. Once the target gas has been established, that is, once the specified volume of gas has been flowed into the system and the pressure in the target chamber reaches approximately 0.5 torr, a valve will be opened which allows a flow of 0.5 to 1 sccm (standard cubic centimeters per minute) of deuterium from the target chamber into the ion source. This gas will re-circulate rapidly through the system, producing approximately the following pressures: in the ion source the pressure will be a few mtorr; in the accelerator the pressure will be around 20 μtorr; over the pumping stage nearest the accelerator, the pressure will be <20 μtorr; over the pumping stage nearest the target chamber, the pressure will be ~50 mtorr; and in the target chamber the pressure will be ~0.5 torr. After these conditions are established, the ion source (using deuterium) will be excited by enabling the RF power supply (coupled to the RF antenna by the RF matching circuit) to about 10-30 MHz. The power level will be increased from zero to about 500 W creating a dense deuterium plasma with a density on the order of $10^{11}$ particles/cm$^3$. The ion extraction voltage will be increased to provide the desired ion current (approximately 10 mA) and focusing. The accelerator voltage will then be increased to 300 kV, causing the ion beam to accelerate through the flow restrictions and into the target chamber. The target chamber will be filled with a magnetic field of approximately 5000 gauss (or 0.5 tesla), which causes the ion beam to re-circulate. The ion beam will make approximately 10 revolutions before dropping to a negligibly low energy.

While re-circulating, the ion beam will create nuclear reactions with the target gas, producing $4\times10^{10}$ and up to $9\times10^{10}$ neutrons/sec for D. These neutrons will penetrate the vacuum vessel, and be detected with appropriate nuclear instrumentation.

Neutral gas that leaks from the reaction chamber into the differential pumping section will pass through the high speed pumps, through a cold trap, and back into the reaction chamber. The cold traps will remove heavier gasses that in time can contaminate the system due to very small leaks.

Example 2

Neutron Source with Linear Target Chamber

Initially, the system will be clean and empty, containing a vacuum of 10-9 torr or lower and the high speed pumps will be up to speed (three stages, with the two nearest that accelerator being turbomolecular pumps and the third being a different pump such as a roots blower). Approximately 1000 standard cubic centimeters of deuterium gas will be flowed into the target chamber to create the target gas. Once the target gas has been established, a valve will be opened which allows a flow of 0.5 to 1 sccm (standard cubic centimeters per minute) from the target chamber into the ion source. This gas will re-circulate rapidly through the system, producing approximately the following pressures: in the ion source the pressure will be a few mtorr; in the accelerator the pressure will be around 20 μtorr; over the pumping stage nearest the accelerator, the pressure will be <20 μtorr; over the center pumping stage the pressure will be ~50 mtorr; over the pumping stage nearest the target chamber, the pressure will be ~500 mtorr; and in the target chamber the pressure will be ~20 torr.

After these conditions are established, the ion source (using deuterium) will be excited by enabling the RF power supply (coupled to the RF antenna by the RF matching circuit) to about 10-30 MHz. The power level will be increased from zero to about 500 W creating a dense deuterium plasma with a density on the order of $10^{11}$ particles/cm$^3$. The ion extraction voltage will be increased to provide the desired ion current (approximately 10 mA) and focusing. The accelerator voltage will then be increased to 300 kV, causing the ion beam to accelerate through the flow restrictions and into the target chamber. The target chamber will be a linear vacuum chamber in which the beam will travel approximately 1 meter before dropping to a negligibly low energy.

While passing through the target gas, the beam will create nuclear reactions, producing $4\times10^{10}$ and up to $9\times10^{10}$ neutrons/sec. These neutrons will penetrate the vacuum vessel, and be detected with appropriate nuclear instrumentation.

Neutral gas that leaks from the reaction chamber into the differential pumping section will pass through the high speed pumps, through a cold trap, and back into the reaction chamber. The cold traps will remove heavier gasses that in time can contaminate the system due to very small leaks.

Example 3

Proton Source with Magnetic Target Chamber

Initially, the system will be clean and empty, containing a vacuum of $10^{-9}$ torr or lower, and the high speed pumps will be up to speed (two stages with each stage being a turbomolecular pump). Approximately 25-30 standard cubic centimeters of gas (an approximate 50/50 mixture of deuterium and helium-3 to generate protons) will be flowed into the target chamber to create the target gas. Once the target gas has been established, that is, once the specified volume of gas has been flowed into the system and the pressure in the target chamber reaches approximately 0.5 torr, a valve will be opened which allows a flow of 0.5 to 1 sccm (standard cubic centimeters per minute) of deuterium from the target chamber into the ion source. This gas will re-circulate rapidly through the system, producing approximately the following pressures: in the ion source the pressure will be a few mtorr; in the accelerator the pressure will be around 20 μtorr; over the pumping stage nearest the accelerator, the pressure will be <20 μtorr; over the pumping stage nearest the target chamber, the pressure will be ~50 mtorr; and in the target chamber the pressure will be ~0.5 torr. After these conditions are established, the ion source (using deuterium) will be excited by enabling the RF power supply (coupled to the RF antenna by the RF matching circuit) to about 10-30 MHz. The power level will be increased from zero to about 500 W creating a dense deuterium plasma with a density on the order of $10^{11}$ particles/cm$^3$. The ion extraction voltage will be increased to provide the desired ion current (approximately 10 mA) and focusing. The accelerator voltage will then be increased to 300 kV, causing the ion beam to accelerate through the flow restrictions and into the target chamber. The target chamber will be filled with a magnetic field of approximately 5000 gauss (or 0.5 tesla), which causes the ion beam to re-circulate. The ion beam will make approximately 10 revolutions before dropping to a negligibly low energy.

While re-circulating, the ion beam will create nuclear reactions with the target gas, producing $1\times10^{11}$ and up to about $5\times10^{11}$ protons/sec. These protons will penetrate the tubes of the isotope extraction system, and be detected with appropriate nuclear instrumentation.

Neutral gas that leaks from the reaction chamber into the differential pumping section will pass through the high speed pumps, through a cold trap, and back into the reaction chamber. The cold traps will remove heavier gasses that in time can contaminate the system due to very small leaks.

Example 4

Proton Source with Linear Target Chamber

Initially, the system will be clean and empty, containing a vacuum of $10^{-9}$ torr or lower and the high speed pumps will be up to speed (three stages, with the two nearest that accelerator being turbomolecular pumps and the third being a different pump such as a roots blower). Approximately 1000 standard cubic centimeters of about 50/50 mixture of deuterium and helium-3 gas will be flowed into the target chamber to create the target gas. Once the target gas has been established, a valve will be opened which allows a flow of 0.5 to 1 sccm (standard cubic centimeters per minute) from the target chamber into the ion source. This gas will re-circulate rapidly through the system, producing approximately the following pressures: in the ion source the pressure will be a few mtorr; in the accelerator the pressure will be around 20 μtorr; over the pumping stage nearest the accelerator, the pressure will be <20 μtorr; over the center pumping stage the pressure will be ~50 mtorr; over the pumping stage nearest the target chamber, the pressure will be ~500 mtorr; and in the target chamber the pressure will be ~20 torr.

After these conditions are established, the ion source (using deuterium) will be excited by enabling the RF power supply (coupled to the RF antenna by the RF matching circuit) to about 10-30 MHz. The power level will be increased from zero to about 500 W creating a dense deuterium plasma with a density on the order of $10^{11}$ particles/cm$^3$. The ion extraction voltage will be increased to provide the desired ion current (approximately 10 mA) and focusing. The accelerator voltage will then be increased to 300 kV, causing the ion beam to accelerate through the flow restrictions and into the target chamber. The target chamber will be a linear vacuum chamber in which the beam will travel approximately 1 meter before dropping to a negligibly low energy.

While passing through the target gas, the beam will create nuclear reactions, producing $1\times10^{11}$ and up to about $5\times10^{11}$ protons/sec. These neutrons will penetrate the walls of the tubes of the isotope extraction system, and be detected with appropriate nuclear instrumentation.

Neutral gas that leaks from the reaction chamber into the differential pumping section will pass through the high speed pumps, through a cold trap, and back into the reaction chamber. The cold traps will remove heavier gasses that in time can contaminate the system due to very small leaks.

Example 5

Neutron Source for Isotope Production

The system will be operated as in Example 1 with the magnetic target chamber or as in Example 2 with the linear target chamber. A solid sample, such as solid foil, of parent material $^{98}$Mo will be placed proximal to the target chamber. Neutrons created in the target chamber will penetrate the walls of the target chamber and react with the $^{98}$Mo parent material to create $^{99}$Mo, which may decay to meta-stable $^{99}$Tn. The $^{99}$Mo will be detected using suitable instrumentation and technology known in the art.

Example 6

Proton Source for Isotope Production

The system will be operated as in Example 3 with the magnetic target chamber or as in Example 4 with the linear target chamber. The system will include isotope extraction system inside the target chamber. Parent material such as water comprising $H_2{}^{16}O$ will be flowed through the isotope extraction system. The protons generated in the target chamber will penetrate the walls of the isotope extraction system to react with the $^{16}$O to produce $^{13}$N. The $^{13}$N product material will be extracted from the parent and other material using an ion exchange resin. The $^{13}$N will be detected using suitable instrumentation and technology known in the art.

In summary, the invention provides, among other things, a compact high energy proton or neutron source. The foregoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Various features and advantages of the invention are set forth in the following claims.

What is claimed is:

1. A compact apparatus for generating nuclear particles, comprising:

an ion source, the ion source configured to produce an ion beam;

an accelerator operatively coupled to the ion source to define an accelerator/ion source region, the accelerator operating at a vacuum pressure and configured to receive the ion beam and accelerate the ion beam to yield an accelerated ion beam; and a gaseous target system operatively coupled to the accelerator, the target system comprising a target chamber operating at a gas pressure within a range of about 1 to about 100 torr to define a higher gas pressure region and configured to contain a gaseous nuclear particle-deriving target material which is reactive with the accelerated beam to emit nuclear particles into the higher gas pressure region via a substantially constant flow of unionized gas molecules, wherein the vacuum pressure of the accelerator defines a lower gas pressure region of the accelerator, and wherein the accelerated ion beam deposits energy in the gaseous target material, and wherein the target system is substantially open to the accelerator/ion source region with no physical barrier preventing a flow of gas molecules from the higher gas pressure region of the target chamber to the lower gas pressure region of the accelerator; and a differential pumping system configured to maintain a first pressure differential between an outside atmosphere and the ion source/accelerator region, a second pressure differential between the outside atmosphere and the target system, and a third pressure differential between the ion source/accelerator region and the target system, the differential pumping system including:

a) a first end being the accelerator/ion source region at the vacuum pressure and a second end being the target chamber at the gas pressure b) at least one vacuum chamber connecting the first end to the second end that allows passage of the ion beam from the first end to the second end of the differential pumping system;

c) at least one vacuum pump connected to each vacuum chamber, the vacuum pump configured to exhaust into an adjacent vacuum chamber that is higher in pressure to maintain the first pressure differential and the second pressure differential and the third pressure differential.

2. The apparatus of claim 1, wherein the target chamber is a magnetic target chamber comprising:

a) a top and a bottom;

b) a first magnet mounted to the top; and c) a second magnet mounted to the bottom, the first and second magnets causing the ion beam in the target chamber to recirculate.

3. The apparatus of claim 1, wherein the target chamber is a linear target chamber.

4. The apparatus of claim 3, wherein the linear target chamber is operatively coupled to a high speed synchronized pump, and wherein the high speed synchronized pump comprises:

a) at least one blade;

b) at least one gap adjacent the at least one blade for allowing passage of the ion beam;

c) at least one timing signal; and d) a controller functionally coupled to the at least one timing signal and the accelerator, the controller functioning to moderate the voltage of the accelerator for allowing passage of the ion beam to the target chamber and to prevent passage of the ion beam to the target chamber.

5. The apparatus of claim 1, wherein the ion source includes:

a) an inlet for entry of a first fluid to be ionized and an outlet;

b) a vacuum chamber including a first and a second end, the first end connected to the inlet;

c) an RF antenna operatively connected to the vacuum chamber for positively ionizing the first fluid to create the ion beam, the vacuum chamber allowing passage of the ion beam from the inlet to outlet of the ion source; and d) an ion injector, operatively connected to the second end of the vacuum chamber, and including a first stage connected to a second stage, the first stage of the ion injector for collimating the ion beam.

6. The apparatus of claim 1, wherein the accelerator is an electrode-driven accelerator.

7. The apparatus of claim 5, wherein the accelerator includes:

a) a first end and a second end, the first end connected to the second stage of the ion injector;

b) a vacuum chamber including an interior and an exterior, extending from the first end to the second end of the accelerator, and allowing passage of the ion beam from the first end to the second end of the accelerator;

c) at least two acceleration electrodes spaced along and each penetrating the chamber interior, to create an electric field with voltage decreasing from the first end to the second end of the accelerator such that the ion beam increases energy from the first end to the second end of the accelerator; and d) an anti-corona ring connected to each acceleration electrode at the chamber exterior, decreasing the electric field.

8. The apparatus of claim 1, further comprising an isotope extraction system, operatively coupled to the target system, for containing an isotope-deriving material.

9. The apparatus of claim 8, wherein the isotope extraction system includes a tubing carrying the isotope-deriving material comprising a second fluid, the nuclear particles penetrating the tubing of the isotope extraction system and reacting with the second fluid to create a radioisotope.

10. The apparatus of claim 9, wherein the target chamber includes walls which are transparent to the nuclear particles and the isotope extraction system is disposed proximate the target chamber.

11. The apparatus of claim 8, wherein the target chamber includes walls which are not transparent to the nuclear particles and the isotope extraction system is disposed within the target chamber.

12. The apparatus of claim 1, further comprising an isotope-deriving material proximate to the target chamber, wherein the nuclear particles penetrate the walls of the target chamber.

13. The apparatus of claim 1, further comprising a gas filtration system connected between the differential pumping system and the target chamber, the gas filtration system comprising:

a) a first end and a second end;

b) a getter trap at the first end of the gas filtration system, connected to the second end of the target chamber, the getter trap configured to trap a hydrogen escaping the target chamber;

c) at least one liquid nitrogen trap at the second end of the gas filtration system, connected to the getter trap, the liquid nitrogen trap configured to trap a fluid impurity escaping the target chamber;

d) at least one vacuum pump isolation valve, moveable between an open and a closed position, including one end connected to the traps, including a second end connected to the vacuum pump exhaust of the differential pumping system, and including a third end; and e) a pump-out valve, moveable between an open and a closed position, connected to the third end of the vacuum pump isolation valve, the pump-out valve configured to allow the fluid impurity to escape the gas filtration system when in the open position and when the vacuum pump isolation valve is in the closed position.

* * * * *